US008485270B2

(12) United States Patent
Fischer

(10) Patent No.: US 8,485,270 B2
(45) **Date of Patent: *Jul. 16, 2013**

(54) EARLY SUPPRESSION FAST RESPONSE FIRE PROTECTION SPRINKLER

(75) Inventor: Michael A. Fischer, West Kingston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/479,364

(22) Filed: May 24, 2012

(65) Prior Publication Data

US 2012/0234562 A1 Sep. 20, 2012

Related U.S. Application Data

(63) Continuation of application No. 12/775,346, filed on May 6, 2010, now Pat. No. 8,186,448, which is a continuation of application No. 12/556,495, filed on Sep. 9, 2009, now Pat. No. 7,735,570, and a continuation of application No. 12/581,412, filed on Oct. 19, 2009, now Pat. No. 7,766,091, and a continuation of application No. 11/624,936, filed on Jan. 19, 2007, now Pat. No. 7,730,959, said application No. 12/581,412 is a continuation of application No. 11/624,936, filed on Jan. 19, 2007, now Pat. No. 7,730,959, said application No. 12/556,495 is a continuation of application No. 11/624,936, filed on Jan. 19, 2007, now Pat. No. 7,730,959, which is a continuation of application No. 09/292,152, filed on Apr. 15, 1999, now Pat. No. 7,165,624, which is a continuation-in-part of application No. 09/134,493, filed on Aug. 14, 1998, now Pat. No. 6,059,044.

(51) Int. Cl.
*A62C 37/36* (2006.01)

(52) U.S. Cl.
USPC ..... 169/37; 169/16; 169/39; 169/46; 239/498; 239/518

(58) Field of Classification Search
USPC ..... 239/37, 16, 39, 46, 496, 518
See application file for complete search history.

(56) References Cited

U.S. PATENT DOCUMENTS 269,930 A 1/1883 Harris
306,662 A 10/1884 Stratton (Continued)

FOREIGN PATENT DOCUMENTS

AU 199865360 9/1998
CA 2462636 8/2005

(Continued)

OTHER PUBLICATIONS

Excerpt from "UL 199, Standard for Automatic Sprinklers for Fire-Protection Service," (Apr. 8, 1997), describing so-called 10 Pan Distribution Test, pp. 31-32.

(Continued)

*Primary Examiner* — Dinh Q Nguyen
(74) *Attorney, Agent, or Firm* — Perkins Coie LLP

(57) ABSTRACT

An early suppression fast response pendent-type fire protection sprinkler is suitable for use in accordance with one or more of NFPA 13, NFPA 231 and NFPA 231C to protect single row rack storage, double row rack storage and multiple row rack storage, the sprinkler having a K-factor of about 25 and flowing pressure of about 15 pounds per square inch. Preferably, the sprinkler has a body defining an orifice and an outlet for delivering a flow of fluid from a source, and a deflector mounted with a first surface opposed to flow of fluid from the outlet. The deflector defines at least one pair of generally opposed reentrant slots extending from the first surface through the deflector, the reentrant slots extending from slot openings at an outer peripheral edge of the deflector inwardly from the peripheral edge toward a deflector axis.

3 Claims, 9 Drawing Sheets

U.S. PATENT DOCUMENTS

| | | | |
|---|---|---|---|
| 316,581 | A | 4/1885 | Stratton |
| 433,477 | A | 8/1890 | Lapham |
| 514,162 | A | 2/1894 | Newton |
| 546,087 | A | 9/1895 | Carpenter |
| 575,121 | A | 1/1897 | Lapham |
| 640,757 | A | 1/1900 | Gates et al. |
| 720,013 | A | 2/1903 | Esty |
| 824,128 | A | 6/1906 | Martin |
| 1,165,313 | A | 12/1915 | Bower |
| 1,285,133 | A | 11/1918 | Gross |
| 1,338,469 | A | 4/1920 | Waage et at |
| 1,816,016 | A | 7/1931 | Knight |
| 1,903,150 | A | 3/1933 | Tyden |
| 2,135,138 | A | 11/1938 | Horace |
| 2,155,990 | A | 4/1939 | Hodgman, Jr. |
| 2,180,258 | A | 11/1939 | Rowley |
| 2,211,399 | A | 8/1940 | Winslow |
| 2,291,813 | A | 8/1942 | Knight |
| 2,291,818 | A | 8/1942 | Loepsinger |
| 2,357,227 | A | 8/1944 | Rowley |
| 2,558,450 | A | 6/1951 | Martin |
| 2,591,872 | A | 4/1952 | Rider |
| 2,697,008 | A | 12/1954 | Rowley |
| 2,724,614 | A | 11/1955 | Rider |
| 2,732,018 | A | 1/1956 | Grimes |
| 2,768,696 | A | 10/1956 | Sherburne |
| 2,862,565 | A | 12/1958 | Dukes |
| 2,871,953 | A | 2/1959 | Bray |
| 3,007,528 | A | 11/1961 | Gloeckler |
| 3,061,015 | A | 10/1962 | Cann, Jr. |
| 3,067,823 | A | 12/1962 | Kavanagh |
| 3,080,000 | A | 3/1963 | Gloeckler |
| 3,135,331 | A | 6/1964 | Lee |
| 3,195,647 | A | 7/1965 | Campbell et al. |
| 3,401,751 | A | 9/1968 | Loftin et al. |
| 3,414,112 | A | 12/1968 | Ravn |
| 3,525,402 | A | 8/1970 | Hattori |
| 3,561,537 | A | 2/1971 | Dix |
| 3,584,689 | A | 6/1971 | Willms |
| 3,625,289 | A | 12/1971 | Gloeckler |
| 3,653,444 | A | 4/1972 | Livingston |
| 3,675,894 | A | 7/1972 | Friedell |
| 3,682,251 | A | 8/1972 | Livingston |
| 3,716,103 | A | 2/1973 | Tanaka et al. |
| 3,722,596 | A | 3/1973 | Livingston |
| 3,743,022 | A | 7/1973 | Livingston |
| 3,768,736 | A | 10/1973 | Cox |
| 3,783,947 | A | 1/1974 | Dix et al. |
| 3,802,512 | A | 4/1974 | Todtenkopf |
| 3,812,915 | A | 5/1974 | Livingston |
| 3,818,994 | A | 6/1974 | Livingston |
| 3,834,463 | A | 9/1974 | Allard et al. |
| 3,888,313 | A | 6/1975 | Freeman |
| 3,896,880 | A | 7/1975 | Asp |
| 3,904,126 | A | 9/1975 | Allard |
| 3,924,687 | A | 12/1975 | Groos |
| 3,927,805 | A | 12/1975 | Stull |
| 3,970,218 | A | 7/1976 | Lee |
| 4,007,878 | A | 2/1977 | Anderson |
| 4,014,388 | A | 3/1977 | Anderson |
| 4,015,665 | A | 4/1977 | Simons et al. |
| 4,066,129 | A | 1/1978 | Anderson |
| 4,079,786 | A | 3/1978 | Moling |
| 4,091,872 | A | 5/1978 | Mountford |
| 4,091,873 | A | 5/1978 | Werner |
| 4,099,675 | A | 7/1978 | Wohler et al. |
| 4,105,076 | A | 8/1978 | Simons et al. |
| 4,113,021 | A | 9/1978 | Werner |
| 4,121,665 | A | 10/1978 | Woycheese |
| 4,136,740 | A | 1/1979 | Groos et al. |
| 4,139,062 | A | 2/1979 | Rago |
| 4,150,811 | A | 4/1979 | Condit |
| 4,177,862 | A | 12/1979 | Bray |
| 4,220,208 | A | 9/1980 | Jackson et al. |
| 4,228,858 | A | 10/1980 | Sclafani |
| 4,237,982 | A | 12/1980 | Sclafani |
| 4,258,795 | A | 3/1981 | Hansen |
| 4,273,195 | A | 6/1981 | Fischer et al. |
| 4,279,309 | A | 7/1981 | Fischer et al. |
| 4,280,562 | A | 7/1981 | Glinecke |
| 4,296,815 | A | 10/1981 | Mears |
| 4,296,816 | A | 10/1981 | Fischer |
| 4,403,626 | A | 9/1983 | Paul, Jr. |
| 4,405,018 | A | 9/1983 | Fischer |
| 4,417,626 | A | 11/1983 | Hansen |
| 4,580,729 | A | 4/1986 | Pounder |
| 4,625,915 | A | 12/1986 | Cockman |
| 4,630,682 | A | 12/1986 | Pieczykolan |
| 4,657,085 | A | 4/1987 | Jacobsen |
| 4,732,216 | A | 3/1988 | Polan |
| 4,800,961 | A | 1/1989 | Klein |
| 4,880,063 | A | 11/1989 | Leininger et al. |
| 4,893,679 | A | 1/1990 | Martin et al. |
| 4,901,799 | A | 2/1990 | Pepi et al. |
| 4,930,578 | A | 6/1990 | Barnett et al. |
| 4,976,320 | A | 12/1990 | Polan |
| 5,020,601 | A | 6/1991 | Retzloff et al. |
| 5,022,468 | A | 6/1991 | Byrne |
| 5,036,923 | A | 8/1991 | Shea |
| 5,094,298 | A | 3/1992 | Polan |
| 5,143,657 | A | 9/1992 | Curtis |
| 5,152,344 | A | 10/1992 | Fischer et al. |
| 5,188,185 | A | 2/1993 | Mears |
| 5,190,222 | A | 3/1993 | Haruch |
| 5,195,592 | A | 3/1993 | Simons |
| 5,228,520 | A | 7/1993 | Gottschalk |
| D348,719 | S | 7/1994 | Dolan |
| 5,333,794 | A | 8/1994 | Haruch |
| 5,366,022 | A | 11/1994 | Meyer et al. |
| 5,373,989 | A | 12/1994 | Hattori |
| 5,392,993 | A | 2/1995 | Fischer |
| 5,415,239 | A | 5/1995 | Kotter et al. |
| 5,523,682 | A | 6/1996 | Leon |
| 5,533,576 | A | 7/1996 | Mears |
| 5,570,713 | A | 11/1996 | Stoltz et al. |
| 5,579,846 | A | 12/1996 | Meyer et al. |
| 5,584,344 | A | 12/1996 | Meyer et al. |
| 5,609,211 | A | 3/1997 | Meyer et al. |
| 5,628,367 | A | 5/1997 | Truax et al. |
| 5,664,630 | A | 9/1997 | Meyer et al. |
| 5,669,449 | A | 9/1997 | Polan et al. |
| 5,687,914 | A | 11/1997 | Bosio et al. |
| 5,722,599 | A | 3/1998 | Fries |
| 5,753,149 | A | 5/1998 | Shepherd et al. |
| 5,775,431 | A | 7/1998 | Ondracek |
| 5,810,263 | A | 9/1998 | Tramm |
| 5,829,532 | A | 11/1998 | Meyer et al. |
| 5,829,684 | A | 11/1998 | Fishcer |
| 5,839,667 | A | 11/1998 | Fischer |
| 5,862,994 | A | 1/1999 | Pounder et al. |
| 5,865,256 | A | 2/1999 | Pounder |
| 5,890,657 | A | 4/1999 | Ponte |
| 5,915,479 | A | 6/1999 | Ponte |
| 5,957,392 | A | 9/1999 | Pincus |
| 5,967,240 | A | 10/1999 | Ondracek |
| 6,000,473 | A | 12/1999 | Reilly |
| 6,029,749 | A | 2/2000 | Reilly et al. |
| 6,059,044 | A | 5/2000 | Fischer |
| 6,098,718 | A | 8/2000 | Sato |
| 6,152,236 | A | 11/2000 | Retzloff et al. |
| 6,155,494 | A | 12/2000 | Fabbri et al. |
| 6,158,520 | A | 12/2000 | Reilly et al. |
| 6,216,793 | B1 | 4/2001 | Sundholm |
| 6,246,333 | B1 | 6/2001 | Doner et al. |
| 6,276,460 | B1 | 8/2001 | Pahila |
| 6,367,559 | B1 | 4/2002 | Winebrenner |
| 6,446,732 | B1 | 9/2002 | Polan |
| 6,450,265 | B1 | 9/2002 | Ponte |
| 6,454,017 | B1 | 9/2002 | Fischer et al. |
| 6,502,643 | B1 | 1/2003 | Meyer et al. |
| 6,554,077 | B2 | 4/2003 | Polan |
| 6,851,482 | B2 | 2/2005 | Dolan |
| 6,868,917 | B2 | 3/2005 | Meyer |
| 6,976,543 | B1 | 12/2005 | Fischer |
| 7,036,603 | B2 | 5/2006 | Thomas et al. |
| 7,143,834 | B2 | 12/2006 | Dolan |
| 7,165,624 | B1 | 1/2007 | Fischer |

| | | | | |
|---|---|---|---|---|
| 7,275,603 | B2 | 10/2007 | Polan | |
| 7,559,376 | B2 | 7/2009 | Silva, Jr. | |
| 7,624,812 | B2 | 12/2009 | Pahila | |
| 7,730,959 | B2 | 6/2010 | Fischer | |
| 7,735,570 | B2 | 6/2010 | Fischer | |
| 7,766,091 | B2 | 8/2010 | Fischer | |
| 7,819,201 | B2 | 10/2010 | Pounder et al. | |
| 8,162,069 | B2 * | 4/2012 | Multer et al. | 169/37 |
| 8,172,001 | B2 * | 5/2012 | Tow et al. | 169/38 |
| 8,176,988 | B2 | 5/2012 | Fischer | |
| 8,186,448 | B2 | 5/2012 | Fischer | |
| 2002/0050531 | A1 | 5/2002 | Dolan | |
| 2003/0075343 | A1 | 4/2003 | Ballard | |
| 2005/0121206 | A1 | 6/2005 | Dolan | |
| 2005/0173562 | A1 | 8/2005 | Franson et al. | |
| 2006/0060361 | A1 | 3/2006 | Pounder et al. | |
| 2006/0102362 | A1 | 5/2006 | Polan | |
| 2006/0113093 | A1 | 6/2006 | Silva, Jr. | |
| 2007/0114046 | A1 | 5/2007 | Munroe | |
| 2007/0114047 | A1 | 5/2007 | Fischer | |
| 2007/0187116 | A1 | 8/2007 | Jackson et al. | |
| 2007/0246232 | A1 | 10/2007 | Pahila | |
| 2008/0257564 | A1 | 10/2008 | Cordell et al. | |
| 2009/0126950 | A1 | 5/2009 | Rogers | |
| 2009/0211772 | A1 | 8/2009 | Silva, Jr. | |
| 2009/0294138 | A1 | 12/2009 | Jackson et al. | |
| 2010/0032173 | A1 | 2/2010 | Fischer | |
| 2010/0071916 | A1 | 3/2010 | Fischer | |
| 2010/0212918 | A1 | 8/2010 | Fischer | |

FOREIGN PATENT DOCUMENTS

| | | | |
|---|---|---|---|
| CA | 2358744 | | 9/2009 |
| DE | 2508355 | A1 | 9/1976 |
| DE | 2700431 | A1 | 7/1978 |
| DE | G8708851.7 | | 9/1987 |
| DE | 3910287 | A1 | 10/1990 |
| DE | 4103862 | | 8/1992 |
| DE | 4136912 | A1 | 5/1993 |
| DE | 4480591 | T1 | 3/1996 |
| DE | 4480591 | C2 | 11/2000 |
| EP | 0 695 562 | A2 | 2/1996 |
| GB | 765125 | | 1/1957 |
| GB | 1307095 | | 2/1973 |
| GB | 1556217 | | 11/1979 |
| GB | 1570080 | | 6/1980 |
| GB | 2195241 | A | 4/1988 |
| GB | 2206043 | A | 12/1988 |
| GB | 2293337 | A | 3/1996 |
| GB | 2293337 | B | 8/1997 |
| GB | 2336777 | | 11/1999 |
| JP | 49-98198 | | 8/1974 |
| JP | 50-16793 | | 2/1975 |
| JP | 54-143100 | | 10/1979 |
| JP | 3-27259 | | 3/1991 |
| JP | 4-150873 | | 5/1992 |
| JP | 04-329969 | | 11/1992 |
| JP | 11-104262 | | 4/1999 |
| WO | WO 82/00603 | | 3/1982 |
| WO | WO 95/19851 | | 7/1995 |
| WO | WO98/18525 | | 5/1998 |
| WO | WO 98/18525 | | 5/1998 |
| WO | WO 98/28042 | | 7/1998 |
| WO | WO 2006/058330 | | 6/2006 |

OTHER PUBLICATIONS

Underwriters Laboratories Inc., UL 1767, "Standard for Safety, Early-Suppression Fast-Response Sprinklers," First Edition, Feb. 1990.

Factory Mutual Engineering Corp., "Loss Prevention Data 2-2, Early Suppression Fast Responses Sprinklers," Apr. 1987.

Factory Mutual Research, "Approval Standard, Early Suppression Fast Responses Automatic Sprinklers," Jun. 1986.

"Automatic" Sprinkler Corporation of America product sheets entitled Automatic ESFR Glass Bulb Sprinkler, Feb. 1988, pp. J 5.3, J 5.4.

ASCOA First Systems data sheets entitled "Automatic ESFR Glass Bulb Sprinkler," Mar. 1992, pp. 1.1, 1.2.

Grinnell Corporation data sheets entitled "Early Suppression Fast Response Sprinklers/Model ESFR-1 Pendent, 14.3 K-Factor," Apr. 1988.

Reliable Automatic Sprinkler product announcement, "ESFR Model H Early Suppression Fast Response Sprinklers," Oct. 1992, 3 pp. total.

Central Sprinkler Company catalog sheets entitled Central ESFR-1 3-93/ESFR Early Suppression Fast Response, Mar. 1993, 4 pps.

Drawing entitled, "International Jumbo Sprinkler Head-Deflector," DWG No. 1-117, Automatic Sprinkler Co. of America, Mar. 1926, 1 pg.

Sheet entitled, "Grinnell Jumbo Sprinkler Issue A," Grinnell Corp., Feb. 1969, 1 pg.

Drawing entitled "Solder-Type-Issue A 1/14," Grinnell Sprinkler Yoke, Body, Strut, Diaphragm and Disc, General Fire Extinguisher Company, Apr. 1917, 1 pg.

Drawing entitled "1 Grinnell Jumbo Sprinkler Detail Solder Type Issue A," General Fire Extinguisher Co., Apr. 1917, 1 pg.

NJ Thompson, Fire Behavior and Sprinklers, Chapter 6, "Automatic Sprinkler Protection," National Fire Protection Association, 1964, Forward, Table of Contents, pp. 72-91.

Newsletter for Fire Protection Engineers and Industry, No. 11, Jul. 1968, Orinda, California, 8 pp.

D.G. Goodfellow et al., Technical Report entitled "Optimization of Sprinkler Protection for United States Postal Service III. Protection of Plastic Letter Trays," Factory Mutual Research Corp., Oct. 1971, 39 pp.

D.G. Goodfellow et al., Technical Report entitled "Optimization of Sprinkler Protection for United States Facilities/IV Protection of Plastic Letter Trays with 0.64-in. Retrofit Sprinklers," Factory Mutual Research Corporation, Jul. 1974, 30 pp. with cover and introductory pages.

E.W.J. Troup, Technical Report entitled "New Developments in Ceiling-Level Protection for the High-Challenge Fire," Factory Mutual Research Corporation, Jan. 1974.

P.J. Chicarello et al., Technical Report entitled "Large-Scale Fire Test Evaluation of Early Suppression Fast Response (ESFR) Automatic Sprinklers," Factory Mutual Research Corp. May 1986, cover-p. 18, pp. 122-128.

C. Yao, "The Development of the ESFR Sprinkler System," First Safety Journal, Elsevier Scientific Ltd., Kidlington, Oxford, 1988, vol. 14, No. 11, pp. 65-73.

C. Yao, "Overview of FMRC's Sprinkler Technology Research," Factory Mutual Research Corporation, May 1992.

Approved Product News, Factory Mutual Engineering Corp., vol. 4, No. 2, Dec. 1998, pp. 1-5, 8-12, 16.

Fire Protection Handbook, 17th Edition, National Fire Protection Association, 1991, Title page, inner page, Table of Contents, p. IX and pp. 5-127 through 5-163 and 5-174 through 5-197.

K. Bell, "Presentation to American Fire Sprinkler Association—Large K-Factor Sprinklers," Nov. 1992, 59 pp. total; 19 pp. text and 40 pp. slide photocopies.

Color photocopies of six color photographs of sprinkler case with "I.S. Co." on deflector and PAT.03 on the body and 1903 stamped on the release link, labeled Jun. 1995, 2 pp.

Color photocopies of six color photographs of sprinkler case with "Globe" and 280 on body, G A S Co. on deflector and stamped 1926 on release ink, labeled Jun. 1995, 2 pp.

Color photocopies of five color photographs of Grinnell Corporation "Jumbo A Automatic Sprinkler-1 ¼" Orifice, labeled Jun. 1995, 2 pp.

Color photocopies of five color photographs of Grinnell Corporation, "Jumbo A" automatic sprinkler—1 orifice, labeled Jun. 1995, 2 pp., body painted red.

Search Report under Section 17, issued by GB Patent Office for corresponding GB Patent Application No. 9911294.8, dated Aug. 24, 1999.

National Fire Protection Associate, NFPA 13—Standard for the Initiation of Sprinkler System, 1996 edition, pp. 13-1 through 13-148.

National Fire Protection Associate, NFPA 231—Standard for General Storage, 1998 edition, pp. 231-1 through 231-31.

National Fire Protection Associate, NFPA 231C—Standard for Rack Storage of Materials, 1998 edition, pp. 231C-1 through 231C-75.

Parent Application, File History of U.S. Appl. No. 09/292,152, filed Apr. 15, 1999, now U.S. Patent No. 7,165,624, Michael Fischer.
Parent Application, File History of U.S. Appl. No. 09/134,493, filed Aug. 14, 1998, now U.S. Patent No. 6,059,044, Michael Fischer.
Parent Application, File History of U.S. Appl. No. 09/079,789, filed May, 15, 1998, now Abandoned, Michael Fischer.
McCormick, Michael G., Staff Engineering Associate, Letter From Underwriters Laboratories Inc., re: Central K25.2 ESFR Sprinkler 10-Pan Distribution Test, Sep. 5, 2007. (3 pages).
Plaintiff Tyco—Complaint in *Tyco Fire Products LP* (Plaintiff Tyco) v. *The Viking Corp.* (6 pages) (Defendant Viking) (Apr. 26, 2007).
Defendant Viking—Answer to Complaint, Affirmative Defenses, Counterclaims and Jury Demand (13 pages) (May 16, 2007).
Plaintiff Tyco—Motion to Strike Affirmative Defenses and Memorandum of Law in Support of Motion to Strike; Reply to Counterclaim of Defendant (14 pages) (Jun. 4, 2007).
Plaintiff Tyco—Motion for Preliminary Injunction; Memorandum of Law in Support; Proposed Order; Declaration of J. Golinveaux (46 pages) (Jun. 13, 2007).
Plaintiff Tyco—Declaration of Donald Pounder in Support of Motion for Preliminary Injunction (37 pages) (Jun. 14, 2007).
Defendant Viking—Motion for Leave to Amend Answer to Complaint, Counterclaims and Jury Demand; Memorandum in Support of Motion; Exhibits A-C (42 pages) (Jun. 21, 2007).
Defendant Viking—Response in Opposition to Plaintiff's Motion to Strike Affirmative Defenses; Proposed Order; Index of Exhibits; Exhibits A-E (95 pages) (Jun. 21, 2007).
Defendant Viking—Response in Opposition to Plaintiff Motion for Preliminary Injunction; Proposed Order; Index of Exhibits; Exhibits A-D, Exhibits F-S (217 pages) (Jul. 16, 2007).
Defendant Viking—Declaration of T. Deegan in Support of Opposition to Plaintiff Motion for Prelim. Injunction, Appendices A1, B1, Cl, Exhibits 1-27 (372 pages) (Jul. 17, 2007).
Defendant Viking—Declaration of S. Franson in Support of Opposition to Plaintiff Motion for Preliminary Injunction (7 pages) (Jul. 17, 2007).
Defendant Viking—First Amended Answer to Complaint, Affirmative Defenses, Counterclaims and Jury Demand (14 pages) (Jul. 19, 2007).
Plaintiff Tyco—First Amended Complaint (6 pages) (Jul. 30, 2007).
Stipulation of Voluntary Dismissal of Action (2 pages) (Jan. 8, 2008).
Pacer—Civil Docket for *Tyco Fire Products LP* v. *The Viking Corporation* Case No. 2:07-cv-01683-WY (E.D. Pa) (Aug. 29, 2008).
Central Sprinkler Company Data Sheets for "Ultra K25 ESFR Low Pressure Early Suppression Fast Response" (4 pages) (1998).
U.S. Appl. No. 11/624,936 (Parent U.S. Appl. No. 12/581,412) "Discussion Materials from the Examiner Interview of Feb. 22, 2010", 313 pages, Ref. Cite No. C1 in IDS filed Mar. 24, 2010.
U.S. Appl. No. 12/556,495 (Publication No. 2010-007-1916 Al) Co-Pending Related Continuation Application of parent U.S. Appl. No. 11/624,936, Mar. 25, 2010.
U.S. Appl. No. 12/581,412 (Publication No. 2010-003-2173 A1) Co-Pending Related Continuation Application of parent U.S. Appl. No. 11/624,936, Feb. 11, 2010.
U.S. Appl. No. 12/775,346 (Publication No. 2010-0212918-A1) Co-Pending Related Continuation Application, Aug. 26, 2010.
U.S. Appl. No. 12/775,368 (Publication No. 2010-0212919-A1) Co-Pending Related Continuation Application, Aug. 26, 2010.
Defendant Reliable—Reliable's Supplemental Response to Tyco's First Set of Interrogatories (Nos. 1-2) plus Supplemental Invalidity Charts—Exhibits A-E, F1,F2, G, H1, H2, I, J, and K, 241 pages, Aug. 5, 2011.
Defendant Reliable—Reliable's Amended Response to Tyco's First Set of Interrogatories (Nos. 1-4) plus Supplemental Invalidity Charts—Exhibits A-E, F1,F2, G, H1, H2, I, J, and K, 230 pages, Oct. 5, 2011.
Defendant Reliable—Prior Art References Produced at REL00039117-REL00039535, (date unknown).
Defendant Reliable—Prior Art References Produced at REL000411194-REL00048269, (date unknown).
Defendant Reliable —Prior Art References Produced at REL00048278-REL00048566, (date unknown).
The Reliable Automatic Sprinkler Co., Inc., Datasheet K-22 Magnum Model H22 (SIN R6611) Early Suppression Fast Response (ESFR) Sprinkler, Bulletin 166, Rev. E., Jan. 2006, 2 pages.
ASCOA First Systems data sheets entitled "Automatic ESFR Glass Bulb Sprinkler," Mar. 1992, pp. 1.1, 1.2. REL00042926-REL00042927.
Central Sprinkler Company Data Sheets for "Ultra K25 ESFR Low Pressure Early Suppression Fast Response" (4 pages) (1998). REL00044818-REL00044821.
Grinnell Corporation data sheets entitled "Early Suppression Fast Response Sprinklers/Model ESFR-1 Pendent, 14.3 K-Factor," Apr. 1988. REL00042928-REL00042929.
Reliable Automatic Sprinkler product announcement, "ESFR Model H Early Suppression Fast Response Sprinklers," Oct. 1992, 3 pp. total. REL00042930-REL00042932.
The Reliable Automatic Sprinkler Co., Inc., Datasheet—Model G VELO PEND Very Extra Large Orifice Pendent Sprinkler, NFPA 13,231,and 231C, Bulletin 146A, Oct. 1997, REL00044816-REL00044817.
Internal Tyco Testing Results, (Date Unknown), [TFP421803].
Internal Viking Results, (Date Unknown), [TFP142501].
Photographs of Model ESFR-1, (Date Unknown), [REL00045806-12].
Photographs of Tested Sprinkler, (Date Unknown), [REL00048267-00048269].
Internal Tyco Testing Results, (Date Unknown), [TFP421821].
Photographs of Viking MK1, (Date Unknown), [TFP421824].
Photographs of ASCOA K1 Sprinkler (Exhibit 1), (Date Unknown)—4 pages.
Photographs of Reliable H Sprinkler (Exhibit 2), (Date Unknoen)—4 pages.
Internal Tyco Test Data Results, Apr. 2007, 1 page, Redacted Document [TFP477322].
The Reliable Automatic Sprinkler Co., Inc. Datasheet for Model H Early Suppression Fast Response Sprinkler, Bulletin 150, Nov. 30, 1992.
Plaintiff Tyco—Second Amended Complaint, (13 pages.) (Oct. 4, 2010).
Defendant Reliable—Reliable's Answer, Affirmative Defenses, and Counterclaims in Response to Plaintiffs Second Amended Complaint, (13 pages.) (Oct. 29, 2010).
Plaintiff Tyco—Answer to Counterclaims, (3 pages) (Nov. 22, 2010).
Defendant Reliable—Reliable's Response to Tyco's First Set of Interrogatories (Nos. 1-4), (8 pages), (Jan. 7, 2011).
Plaintiff Tyco—Plaintiff's List of Terms and Proposed Constructions, (4 pages), (Feb. 8, 2011).
Defendant Reliable—Reliable's Prelimininary List of Claim Terms to be Construed by the Court and Proposed Constructions, (10 pages), (Feb. 8, 2011).
Defendant Reliable—Reliable's Supplemental Response to Tyco's First Set of Interrogatories plus Exhibits A-E, (77 pages), (Mar. 15, 2011).
Plaintiff Tyco—Plaintiff's Memorandum in Support of Its Proposed Claim Construction, (24 pages), (Mar. 17, 2011).
Defendant Reliable—Reliable's Opening Claim Construction Brief, (73 pages), (Mar. 17, 2011).
Defendant Reliable—Reliable's Response to Tyco's Second Set of Interrogatories, (4 pages), (Mar. 30, 2011).
Plaintiff Tyco—Plaintiff's Memorandum in Response to Reliable's Opening Claim Construction Brief, (61 pages), (Apr. 14, 2011).
Defendant Reliable—Reliable's Responsive Claim Construction Brief, (23 pages), (Apr. 14, 2011).
Defendant Reliable—Reliable's Response to Tyco's Third Set of Interrogatories (Nos. 6-8), (8 pages), (May 27, 2011).
Defendant Reliable—Email Comm. from Reliable's Counsel & Reliable's Prop. Amended Answer, Affirmative Defenses . . . (18 pages), (Jun. 23, 2011).
Order signed by Judge Juan R. Sanchez in Civil Action No. 10-3447, Dec. 1, 2011, 6 pages.
USPTO File Wrapper for USP 7,624,812 to Pahila REL00039203-00039526.
USPTO File Wrapper for USP 7,730,959 to Fischer REL00041834-00042755.

Excerpt from "UL 199, Standard for Automatic Sprinklers for Fire-Protection Service," (Apr. 8, 1997), describing 10 Pan Distribution Test, pp. 31-32 REL00042823-REL00042824.
Underwriters Laboratories Inc., UL 1767, "Standard for Safety, Early-Suppression Fast-Response Sprinklers," First Edition, Feb. 1990. REL00042825-REL00042855.
Factory Mutual Engineering Corp., "Loss Prevention Data 2-2, Early Suppression Fast Responses Sprinklers," Apr. 1987 REL00042856-REL00042864.
Factory Mutual Research, "Approval Standard, Early Suppression Fast Responses Automatic Sprinklers," Jun. 1986 REL00042865-REL00042923.
"Automatic " Sprinkler Corporation of America product sheets entitled Automatic ESFR Glass Bulb Sprinkler, Feb. 1988, pp. J 5.3, J 5.4. REL00042924-REL00042925.
Grinnell Corporation data sheets entitled "Early Suppression Fast Response Sprinklers/Model ESFR-1 Pendent, 14.3 K-Factor," Apr. 1988. REL00042928- REL00042929.
Central Sprinkler Company catalog sheets entitled Central ESFR-1 3-93/ESFR Early Suppression Fast Response, Mar. 1993, 4 pps. REL00042933-00042936.
Drawing entitled, "International Jumbo Sprinkler Head-Deflector," DWG No. 1-117, Automatic Sprinkler Co. of America, Mar. 1926, 1 pg. REL00042937.
Sheet entitled, "Grinnell Jumbo Sprinkler Issue A," Grinnell Corp., Feb. 1969, 1 pg. REL00042938.
Drawing entitled "Solder-Type-Issue A ¼," Grinnell Sprinkler Yoke, Body, Strut, Diaphragm and Disc, General Fire Extinguisher Company, Apr. 1917, 1 pg. REL00042939.
Drawing entitled "1 Grinnell Jumbo Sprinkler Detail Solder Type Issue A," General Fire Extinguisher Co., Apr. 1917, 1 pg. REL00042940.
NJ Thompson, Fire Behavior and Sprinklers, Chapter 6, "Automatic Sprinkler Protection," National Fire Protection Association, 1964, Forward, Table of Contents, pp. 72-91. REL00042941-REL00042953.
Newsletter for Fire Protection Engineers and Industry, No. 11, Jul. 1968, Orinda, California, 8 pp. REL00042954-REL00042961.
D.G. Goodfellow et al., Technical Report entitled "Optimization of Sprinkler Protection for United States Postal Service III. Protection of Plastic Letter Trays," Factory Mutual Research Corp., Oct. 1971, 39 pp. REL00042962-REL00043000.
D.G. Goodfellow et al., Technical Report entitled "Optimization of Sprinkler Protection for United States Facilities/IV Protection of Plastic Letter Trays with 0.64-in. Retrofit Sprinklers," Factory Mutual Research Corporation, Jul. 1974, 30 pp. with cover and introductory pages. REL00043001-REL00043030.
E.W.J. Troup, Technical Report entitled "New Developments in Ceiling-Level Protection for the High-Challenge Fire," Factory Mutual Research Corporation, Jan. 1974. REL00043031-REL00043066.
P.J. Chicarello et al., Technical Report entitled "Large-Scale Fire Test Evaluation of Early Suppression Fast Response (ESTR) Automatic Sprinklers," Factory Mutual Research Corp. May 1986 cover-p. 18, pp. 122-128. REL00043067-REL00043096.
C. Yao, "The Development of the ESFR Sprinkler System," First Safety Journal, Elsevier Scientific Ltd., Kidlington, Oxford, 1988, vol. 14, No. 11, pp. 65-73. REL00043097-REL00043105.
C. Yao, "Overview of FMRC's Sprinkler Technology Research," Factory Mutual Research Corporation, May 1992. REL00043106-REL00043132.
Approved Product News, Factory Mutual Engineering Corp., vol. 4, No. 2, Dec. 1998, pp. 1-5, 8-12, 16. REL00043133-REL00043134.
Fire Protection Handbook, 17th Edition, National Fire Protection Association, 1991, Title page, inner page, Table of Contents, p. IX and pp. 5-127 through 5-163 and 5-174 through 5-197. REL00043135-REL00043186.
K. Bell, "Presentation to America Fire Sprinklers Association—Large K-Factor Sprinklers," Nov. 1992, 59 pp. total; 19 pp. text and 40 pp. slide photocopies REL00043187-REL00043245.
Search Report under Section 17, issued by GB Patent Office for corresponding GB Patent Application No. 9911294.8, dated Aug. 24, 1999. REL00043246.
National Fire Protection Associate, NFPA 13—Standard for the Initiation of Sprinkler System, 1996 edition, pp. 13-1 through 13-148. REL00043247-REL00043294.
National Fire Protection Associate, NFPA 231—Standard for General Storage, 1998 edition, pp. 231-1 through 231-31. REL00043395-REL00043425.
National Fire Protection Associate, NFPA 231C—Standard for Rack Storage of Materials, 1998 edition, pp. 231C-1 through :231C-75. REL00043426-REL00043500.
File History of U.S. Appl. No. 09/292,152, filed Apr. 15, 1999, now U.S. Patent No. 7,165,624, Michael Fischer. REL00043501-REL00044194.
File History of U.S. Appl. No. 09/134,493, filed Aug. 14, 1998, now U.S. Patent No. 6,059,044, Michael Fischer. REL00044195-REL00044410.
File History of U.S. Appl. No. 09/079,789, filed May 15, 1998, now Abandoned, Michael Fischer. REL00044411-REL00044801.
McCormick, Michael G., Staff Engineering Associate, Letter From Underwriters Laboratories Inc., re: Central K25.2 ESFR Sprinkler 10-Pan Distribution Test, Sep. 5, 2007. (3 pages). REL00044802-REL00044804.
Color photocopies of six color photographs of sprinkler case with "I.S. Co." on deflector and PAT.03 on the body and 1903 stamped on the release link, labeled Jun. 1995, 2 pp.; color photocopies of six color photographs of sprinkler case with "Globe" and 280 on body, G A S Co. on deflector and stamped 1926 on release ink, labeled Jun. 1995, 2 pp.; Color photocopies of five color photographs of Grinnell Corporation "Jumbo A Automatic Sprinkler-1 ¼" Orifice, labeled Jun. 1995, 2 pp; Color photocopies of five color photographs of Grinnell Corporation, "Jumbo A" automatic sprinkler— 1 Orifice, labeled Jun. 1995, 2 pp., body painted red. REL00044805-REL00044812.
Sprinkler Photo. REL00044813.
The Reliable Automatic Sprinkler Co., Inc., Datasheet—Model G Velo Pend Specific Application NFPA 231C .6 Density/2,000 Sq. Ft., Bulletin 149A, Oct. 1997, REL00044814-00044815.
The Reliable Automatic Sprinkler Co., Inc., Datasheet—Model G Velo Pend Very Extra Large Orifice Pendent Sprinkler, NFPA 13,23,and 231C, Bulletin 146A, Oct. 1997, REL00044816-REL00044817.
GEM Sprinkler Company, Datasheet for Early Suppression Fast Response Sprinklers, Model ESFR-25™ Pendent, 25.2 K-Factor, 1 inch NPT, Feb. 2000, (4 pages), REL00044822-REL00044825.
GEM Sprinkler Company, Datasheet for Early Suppression Fast Response Sprinklers (FM) & Specific Application ESFR Sprinklers (UL & C-UL), Model ESFR-25™ Pendent, Nov. 1998, (4 pages) REL00044826-REL00044829.
Plaintiff Tyco—Complaint in *Tyco Fire Products LP* (Plaintiff Tyco) v. *The Viking Corp*. (6 pages) (Defendant Viking) (Apr. 26, 2007). REL00044830-REL00044835.
Defendant Viking—Answer to Complaint Affirmative Defenses, Counterclaims and Jury Demand (13 pages) (May 16, 2007). REL00044836-REL00044848.
Plaintiff Tyco—Motion to Strike Affirmative Defenses and Memorandum of Law in Support of Motion to Strike; Reply to Counterclaim of Defendant (14 pages) (Jun. 4, 2007). REL00044849-REL00044862.
Plaintiff Tyco—Motion for Preliminary Injunction; Memorandum of Law in Support; Proposed Order; Declaration of J. Golinveaux (46 pages) (Jun. 13, 2007). REL00044863- REL00044908.
Plaintiff Tyco—Declaration of Donald Pounder in Support of Motion for Preliminary Injunction (37 pages) (Jun. 14, 2007). REL00044909-REL00044945.
Defendant Viking—Motion for Leave to Amend Answer to Complaint, Counterclaims and Jury Demand; Memorandum in Support of Motion; Exhibits A-C (42 pages) (Jun. 21, 2007). REL00044946-REL00044987.
Defendant Viking—Response in Opposition to Plaintiff's Motion to Strike Affirmative Defenses; Proposed Order; Index of Exhibits; Exhibits A-E (95 pages) (Jun. 21, 2007). REL00044988-REL00045082.

Defendent Viking—Response in Opposition to Plaintiff Motion for Preliminary Injunction; Proposed Order; Index of Exhibits; Exhibits A-D, Exhibits F-S (217 pages) (Jul. 16, 2007). REL00045083-REL0045299.
Defendent Viking—Declaration of T. Deegan in Support of Opposition to Plaintiff Motion for Prelim Injunction, Appendices A1, B1, C1, Exhibits 1-27 (372 pages) (Jul. 17, 2007). REL00045300-REL00045671.
Defendant Viking—Declaration of S. Franson in Support of Opposition to Plaintiff Motion for preliminary Injunction (7 pages) (Jul. 17, 2007). REL00045672-REL00045678.
Defendant Viking—First Amended Answer to Complaint; Affirmative Defenses, Counterclaims and Jury Demand (l4 pages) (Jul. 19, 2007) REL00045679-REL00045692.
Plaintiff Tyco—First Amended Complaint (6 pages) (Jul. 30, 2007). REL00045693-REL00045698.
Stipulation of Voluntary Dismissal of Action (2 pages) (Jan. 8, 2008), REL00045699-REL00045700.
Pacer—Civil Docket for *Tyco Fire Products LP* v. *The Viking Corporation* Case No. 2:07-cv-01683-WY (E.D. Pa) (Aug. 29, 2008). REL00045701 -REL00045709.
Sprinkler Photo (VK510 identified as Exhibit C) REL00045784.
Sprinkler Photo (VK503 identified as Exhibit D) REL00045785.
Factory Mutual Research, Preliminary Guidelines, ESFR Sprinklers, Prepared for Participants in the ESFR Program; Jan. 1984 (Identified as Exhibit F). REL00045786-REL00045797.
Transportion and Distribution, "ESFRS: Superior Warehouse Fire Protection", Sep. 1989 (Identified as Exhibit H). REL00045798-REL00045799.
National Engineer, "Early Suppression-Fast Response Sprinklers: A New Level of Industrial Fire Protection", Sep. 1989 (Identified as Exhibit G). REL00045800-REL00045801.
The Viking Corporation; Engineering drawings of Model ESFR 25K Pendent Sprinkler Deflector; Sep. 30, 2002; 1 sheet. REL00045802.
The Viking Corporation; Engineering drawings Deflector, Pendent Sprinkler of Model 17K Dry Pendent Sprinkler; Nov. 29, 2006; 1 sheet. REL00045803.
Gem Sprinkler—Datasheet for Early Suppression Fast Response Sprinklers Model ESFR—1 Pendent, 14,3 K-Factor, Apr. 1988 (2 pages), REL00045804-REL00045805.
Sprinkler Photos, REL00045806-REL00045812.
National Fire Protection Association. NFPA 13 Standard for the Installation of Sprinkler Systems, pp. 13-21 to 13-22, 2 pages, 2002 edition. REL00045813-REL00045815.
Testing Data for Central 1997 K25 ESFR PD—UL 199 Rotating 10 Pan, dated Jul. 12, 2007, 1 page. REL00045816.
National Fire Protection Association, NFPA 13, Special Designs of Storage Protection, 2007 Edition, p. 13-189, REL00045817.
National Fire Protection Association, NFPA 13, Installation of Sprinkler Systems, 2007 Edition, p. 13-186. REL00045818.
Sprinkler Photos, Central 1997 K25 ESFR PD. REL00045819.
Central Sprinkler Company Data Sheets for "Ultra K25 ESFR Low Pressure Early Suppression Fast Response" (4 pages) (1998), REL00045820-REL00045823.
The Viking Corporation—Dry Pendent Sprinklers Model C, Sprinkler 101, Jan. 1987 (4 pages), REL00046079-REL00046082.
Chemetron Fire Systems, Star Model ME-1 Flush Type Dry Pendent REL00046083-REL00046084.
Total Walther Feuerschutz GmbH, Hangender Trockensprinkler GHTS 15, Dry Pendent Sprinkler—Sprinkler Anti-gel, Jan. 17, 1989, 2 pages, REL00046085-REL00046086.
The Reliable Automatic Sprinkler Co., Inc., Datasheet for Model G3 Dry Sprinkler, Bulletin 116D, 4 pages. REL00046087-REL00046090.
Victanlic Company, Darasheet for 40.61, Models V3608 and V3607 Standard Spray Pendent and Recessed Pendent Standard and Quick Response; 3124, Revision A, 2001, 4 pages, REL00046091-REL00046094.
Victaulic Company, Datasheet for 40.63, Models V3604 and V3603 Dry Type Upright; 3126, Revision A, 2001, 4 pages, REL00046095-REL00046098.
Globe Fire Sprinkler Corporation, Datasheet for Automatic Sprinklers Model J Bulb Spray Series Dry Type Pendent Recessed Pendent, Bulletin ASB-DP, Aug. 1990, 2 pages. REL00046099-REL00046102.
Grinnell Corporation, Datasheet for Dry Pendent Sprinklers, Issue C Solder Type, ½ Orifice, Jul. 1986. REL00046103-REL00046106.
Grinnell Corporation, Datasheet for Dry Pendent Sprinklers, Model F960 Designer ½ Orifice, Jul. 1986. REL00046107-REL00046110.
Central Sprinkler Corporation, Dry Pendent Sprinklers Recessed, Flush and Extended Types Model "A-1", 1986, REL00046111-REL00046112.
Preussag Minimax. "Sprinkler-Teile/Parts Trockensprinkler dry sprinkler", 2 sheets, Jan. 1989. REL00046113-REL00046114.
Dry Pendent Drop Sprinkler, Data Sheet AS.159, 2 pages REL00046115-REL00046116.
Engineering drawings of the Dry Pendent Drop Sprinkler described in Data Sheet AS.159, 10 pages. REL00046117-REL00046126.
First Sprinkler—Color Photo 01; First Sprinkler—Color Photo 02; First Sprinkler—Color Photo 03; First Sprinkler—Color Photo 04; First Sprinkler—Color Photo 05; Second Sprinkler—Color Photo 06; Second Sprinkler—Color Photl 07; Second Sprinkler—Color Photo 08. REL00046127-REL00046134.
Response to Office Action, US 2007/0187116, Mar. 13, 2008, pp. 1-25. REL00046135-REL00046159.
Office Action, US 2007/0187116, Dec. 13, 2007, pp. 1-13. REL00046160-REL00046172.
Grinnell Corporation; Dry Sprinklers, Quick Response, Data Sheet of Model F960; Jun. 1998; 1 sheet. REL00046173.
Grinnell Corporation; Engineering drawings of Model F960 Dry Pendent Bulb Type Sprinkler Yoke; Rev. Jan. 3, 1991; 1 sheet. REL00046174.
Grinnell Corporation; Engineering drawings of Model F960 Dry Pendent Bulb-Type Sprinkler Assembly; Apr. 24, 1991; 1 sheet. REL00046175.
Viking Corp.; Technical Data, "Model M Quick Response Dry Pendent Sprinkler"; Apr. 9, 1998; 4 sheets. REL00046176-REL00046179.
"Approval Standard for Automatic Sprinklers for Fire Protection;" Class Series 2000; May 1998; Factory mutual Corporation; pp. 1-90, REL00046180-REL00046184.
Underwriters Laboratories Inc.; "UL 199 Standard for Automatic Sprinklers for Fire-Protection Service" (Sections 20 and 29); Apr. 8, 1997; 4 pages. REL00046185-REL-00046188.
James E. Golinveaux; "A Technical Analysis: The Use and Maintenance of Dry Type Sprinklers" (http://www.tycoFire.comITFP_common/DrySprinklers.pdf); Jun. 2002; 15 pages. REL00046189-REL00046202.
Victaulic; "Models V3606 and V3605 Dry Type Standard Spray Pendent and Recessed Pendent Standard and Quick Response"; 2002; 4 sheets. REL00046203-REL00046206.
"Duraspeed Sprinkler—Rack Storage—Q-17;" Sprinklers, Nozzles and Accessories/Section 4; Grinnell Fire Protection Systems Company, Inc.; Bulletin No. 211; Jan. 1975; 2 pgs. REL00046265-REL00056266.
"Approval Standard for Early Suppression-Fast Response (ESFR) Automatic Sprinklers;" Class No. 2008; Aug. 1996; Factory Mutual Research Corporation; pp. 1-47. REL00046267-REL00046319.
"Installation of Sprinkler Systems;" NFPA 13; 1999 Edition; National Fire Protection Association. REL00046320-REL00046636.
"Approval Standard for Automatic Sprinklers for Fire Protection;" Class Series 2000; May 1998; Factory mutual Corporation; pp. 1-90. REL00046637-REL00046641.
"Application of the Tyco Fire Products;" Sep. 2007, 21 pages, Tyco Fire & Building Products [online] [retrieved Oct. 30, 2007 from the Intenet: URL<http://www.tyco-fire.com/TFP_common/EC25_EC17_WhitePaper.pdf>] REL00046642-REL000046663.
Central Sprinkler Company, Datasheet for Central ESFR Early Suppression Fast Response Pendent Automatic Sprinkler—ESFR-1, 1-95, No. 2-13.0 , 4 pages, 1995, REL00047029-REL00047032.

GEM Sprinkler Company Press Release and Announcement, "Gem Sprinkler Company Introduces New 11.2 K-Factor ECLH Pendent and Recessed Pendent Sprinklers", Oct. 7, 2009, 3 Pages, REL00047033-REL00047035.
Page dated Nov. 2004 identifying Viking's K-17 Sprinkler and Viking's Extended Coverage, Ordinary Hazard. REL00047036.
USTO File Wrapper for USP 7,624,812 to PAHILA. REL000047057-REL000047443.
USPTO File Wrapper for USP 5,775,431 to ONDRACEK. REL00047444-REL00047547.
USPTO File Wrapper for USP 5,967,240 to ONDRACEK. REL00047548-REL00047630.
USTO File Wrapper for USP 6,450,265 to PONTE. REL00047631-REL00047739.
Underwriters Laboratories Inc. Directory, Fire Protection Equipment 1996, REL00047740-REL00047759.
The Reliable Automatic Sprinkler Co., Inc. Datasheet for Model G VELO Pendent Very Extra Large Orifice Sprinkler, Bulletin 146, Rev. E, Oct. 2009, REL00047760-REL00046671.
Viking Corp.; Technical Datasheet, "Model M Quick Response Extra-Large Orifice Sprinkler"; Jul. 16, 1998; 3 sheets. REL00047762-REL00047764.
Central Sprinkler Company, Datasheet for Central ELO-231 Storage Upright or Pendent Automatic Sprinkler K-Factor = 11.4, No. 2-9.-0, 1994. REL00047765-REL00047768.
Sprinkler Photos, 1 page REL00047769.
Sprinkler Photos, 3 pages REL00047770-REL00047772.
Sprinkler Photos, 3 pages REL00048267-REL00048269.

* cited by examiner

EARLY SUPPRESSION FAST RESPONSE FIRE PROTECTION SPRINKLER

CROSS REFERENCE TO RELATED APPLICATIONS

This application is a continuation of U.S. patent application Ser. No. 12/775,346, filed May 6, 2010 which is now issued as U.S. Pat. No. 8,186,448 on May 29, 2012, which is a continuation of U.S. patent application Ser. Nos. 12/556,495, filed Sep. 9, 2009 which is now issued as U.S. Pat. No. 7,735,570 on Jun. 15, 2010, 12/581,412, filed Oct. 19, 2009 which is now issued as U.S. Pat. No. 7,766,091 on Aug. 3, 2010 and 11/624,936, filed Jan. 19, 2007 now issued as U.S. Pat. No. 7,730,959 on Jun. 8, 2010; 12/581,412 is a continuation of U.S. patent application Ser. No. 11/624,936, filed Jan. 19, 2007, 12/556,495 is a continuation of U.S. patent application Ser. No. 11/624,936, filed Jan. 19, 2007, 11/624,936 is a continuation of U.S. patent application Ser. No. 09/292,152, filed Apr. 15, 1999, which is now issued as U.S. Pat. No. 7,165,624 on Jan. 23, 2007, and a continuation-in-part of U.S. application Ser. No. 09/134,493, filed Aug. 14, 1998, which is now issued as U.S. Pat. No. 6,059,044 on May 9, 2000.

BACKGROUND OF THE INVENTION

Fire protection sprinklers may be operated individually, e.g. by a self-contained thermally sensitive element, or as part of a deluge system in which fire retardant fluid flows through a number of open sprinklers, essentially simultaneously. Fire retardant fluids may include natural water or appropriate mixtures of natural water and one or more additives to enhance fire fighting properties of a fire protection system.

Fire protection sprinklers generally include a body with an outlet, an inlet connectable to a source of fire retardant fluid under pressure, and a deflector supported by the body in a position opposing the outlet for distribution of the fire retardant fluid over a predetermined area to be protected from fire. Individual fire protection sprinklers may be automatically or non-automatically operating. In the case of automatically operating fire protection sprinklers, the outlet is typically secured in the normally closed or sealed position by a cap. The cap is held in place by a thermally-sensitive element which is released when its temperature is elevated to within a prescribed range, e.g. by the heat from a fire. The outlets of non-automatic sprinklers are maintained normally open, and such sprinklers are operated in an array, as part of a deluge system, from which fire retardant fluid flows when an automatic fluid control valve is activated by a separate fire, e.g. heat, detection system.

Installation or mounting position is another parameter which distinguishes different types of fire protection sprinklers. For example: Pounder U.S. Pat. No. 4,580,729 illustrates a pendent mounting (i.e., pendent-type) sprinkler arranged so that the fluid stream discharged from the outlet is directed initially downwards against the deflector; Dukes U.S. Pat. No. 2,862,565 illustrates an upright mounting (i.e., upright-type) sprinkler arranged so that the fluid stream discharged from the outlet is directed initially upwards against the deflector; and Mears U.S. Pat. No. 4,296,815 and Fischer U.S. Pat. No. 4,296,816 illustrate a horizontal mounting (i.e., horizontal-type) sprinkler arranged so that the fluid stream discharged from the outlet is directed initially horizontally against the deflector. In each case, the purpose of the deflector is to break up the fluid stream into a pattern of spray that can suitably cover the area to be protected by the sprinkler from fire.

ESFR (Early Suppression Fast Response) fire protection sprinkler applications have typically required the use of pendent sprinklers. Upright and horizontal sprinklers have generally been found less suitable for ESFR applications, particularly at commodity storage heights of greater than 30 feet. This is because upright sprinklers inherently have reduced downward spray directly beneath the sprinklers and, therefore, underneath the fire protection fluid supply piping from which they are fed. Horizontal type sprinklers, on the other hand, are generally designed with a spray pattern that projects horizontally to protect more remote reaches of the intended coverage area and, as such, do not provide the downward thrust of fluid spray necessary for ESFR sprinkler applications, over the entire area to be protected from fire by the sprinkler.

The concept underlying ESFR sprinkler technology is that of delivering onto a fire at an early stage a quantity of water sufficient to suppress the fire before a severe challenge can develop. ESFR sprinklers are particularly useful in commercial settings where the clearance between the sprinklers and the source of the fire could be large. For example, in a warehouse having high ceilings, the distance between pendent sprinklers and the upper surfaces of combustible commodities in the storage racks can be relatively large. In such settings, the size of a fire can grow significantly before a first sprinkler is activated by heat from the fire. Thus, it was recognized that to suppress a fire in such a setting, a greater quantity of water should be delivered quickly so that the fire will be kept less intense, and the corresponding convective heat release rate will be kept lower. In turn, with a lower heat release rate, the upward plume velocity of the fire will also be relatively lower. Fire protection specialists often characterize this concept by saying that the Actual Delivered Density (ADD) of the first operating sprinkler(s) should exceed the Required Delivered Density (RDD). RDD is defined as the actual density of fire retardant fluid required to suppress a fire in a particular combustible commodity in units of $gpm/ft^2$. ADD is generally defined as the density at which water is actually deposited from operating sprinklers onto the top horizontal surface of a burning combustible array, in units of $gpm/ft^2$.

The relationships between sprinkler spray patterns, fire plume velocity, and amount of combustible commodity are important factors which need to be taken into account in the design of ESFR sprinklers. As the ceiling-to-floor distance increases and the amount of combustible commodity increases, the fire plume velocity and upward thrust increase to such vigorous levels that standardized tests now require actual opposing thrust specifications in the central area of the spray pattern for certification of an automatic fire protection sprinkler for service in the ESFR sprinkler category (Ref Underwriters Laboratories (UL) and Factory Mutual (FM) ESFR Sprinkler Standards). Previous approaches for addressing higher elevation, higher challenge fire protection applications with ESFR pendent sprinklers have included using deflectors with straight slots or slots that taper to become slightly wider in the radially outward direction, in combination with increasing fluid water pressure to compensate for increased elevations, since the thrust of the spray pattern is a combination of both velocity and mass of the fire retardant fluid droplets.

ESFR pendent sprinklers often provide a sprinkler spray pattern having a central downward thrusting core formation. Providing a central core of high thrust droplets is particularly important in higher elevation, higher challenge fire protection applications where the updraft of a quickly developing fire located under a sprinkler head could fully displace the spray pattern of the sprinkler head if the downward thrust was insufficient to effectively oppose the updraft. One approach for providing more water coaxial with the centerline of the sprinkler spray pattern is described in Mears U.S. Pat. No. 4,296,815, the entire disclosure of which is incorporated herein by reference. Mears '815 describes a horizontal sidewall sprinkler with a discharge which increases the amount of fire protection fluid in the region coaxial with the sprinkler discharge axis by use of a deflector with radially extending tines spaced by reentrant slots. A reentrant slot is defined as a cutout extending through a deflector and generally radially inwardly from an opening at the deflector periphery, the slot having a transverse width which is larger at a more radially inward portion of the deflector than the transverse width nearer the peripheral region of the deflector.

SUMMARY OF THE INVENTION

The invention relates to pendent-type fire protection sprinklers of the type including a sprinkler body defining an orifice and an outlet for delivering a flow of fluid from a source, and at least one arm extending from the sprinkler body. The orifice defines an orifice axis, and the outlet is disposed generally coaxial with the orifice axis. The sprinkler also includes an apex element supported by the arm, with an apex axis generally coaxial with the orifice axis, and a deflector mounted to the apex element at a distance further from the outlet than the apex element.

In a general aspect of the invention, the deflector includes a deflector body defining a first, inside surface opposed to the flow of fluid, an opposite, second surface, and a deflector axis generally coaxial with the orifice axis. The deflector body defines two or more generally opposing reentrant slots extending through the deflector body, from the first, inside surface to the second, outside surface, with the slot openings at an outer peripheral edge of the deflector body. The reentrant slots extend inwardly from the peripheral edge, each along a reentrant slot centerline or axis, generally toward the deflector axis. Each reentrant slot also has a first width measured transverse to the slot centerline in a region of the peripheral edge and a second width measured transverse to the slot centerline at a regions spaced inwardly, toward the deflector axis, relative to the region of the peripheral edge, the second width being greater than the first width. The innermost portion of each reentrant slot extends inwardly toward the deflector axis so as to be no further outward from the deflector axis than the outermost surface of the apex element.

The portion of the deflector between the slots extending inward from the periphery of the deflector and the larger width opening at the radially more inward portion of the deflector provides a web-like component spray pattern extending outward from the central core formation.

Pendent-type fire protection sprinklers of the invention are fixed deflector, impingement-type fire protection sprinklers in which the body defines an inlet for connection to a source of fluid under pressure, an outlet, and an orifice normally located just upstream of the outlet. The outlet may be normally closed by a plug held in place by a thermally responsive element configured to automatically release the plug when the temperature of the thermally responsive element is elevated to within a prescribed range. Upon operation (i.e., release of the plug), whether the fire protection sprinkler is individually operated or used open as part of a local application or total flooding system, a vertically directed, relatively coherent, single stream of water (downward for pendent-type sprinklers) rushes through the outlet, from the orifice, towards the deflector. As it impacts (i.e., impinges) upon the deflector, the water is diverted generally radially downward and outward, breaking up into a spray pattern, the configuration of which, in large part, is a function of the deflector design, and it is projected over the intended area of coverage, i.e., the protected area.

The flow rate "Q" from a sprinkler in which a single stream of water is discharged from the outlet orifice, expressed in U.S. gallons per minute (gpm), is determined by the formula:

$$Q=K(P)^{1/2}$$

where: "K" represents the nominal nozzle discharge coefficient (normally referred to as K-factor), and "p" represents the residual (flowing) pressure at the inlet to the nozzle in pounds per square inch (psi).

Fire protection sprinklers of the invention operate by impacting a relatively coherent, single fluid jet against the deflector described above. The sprinkler has a K-factor preferably in a range of from about 8.0 to 50.0, more preferably in the range of about 14.0 to about 30.0, and most preferably about 25.0, the range from about 14.0 to 30.0 being found more preferable from the standpoint of minimizing fire protection system installation costs and operating power requirements.

Larger K-factors have been determined to be capable of delivering quantities of fire retardant fluid sufficient for an ESFR sprinkler application. As the elevation of the particular hazard increases (i.e., taller warehousing), the pressure required to deliver quantities of fluid sufficient to produce the downward thrust necessary to oppose well developed fire updrafts from such elevations becomes so high as to be impractical when K-factors are less than about 8.0. However, for K-factors of about 14.0 or greater, and at the required delivered rate of fire retardant fluids, a sprinkler pressure sufficient to produce the required downward thrust by traditional deflector means is practical to achieve, but may not be as economical as desired.

In preferred embodiments, the deflector compensates for the lower droplet velocities at the lower inlet pressures desirable for the larger K-factor sprinklers by diverting an optimized portion of the spray selectively directed within the spray pattern. The deflector is provided with at least one set of reentrant slots positioned so that their most radially inward portion is no further outward from the deflector axis than the outermost surface of the apex element of the sprinkler frame. With this arrangement, there is diverted a quantity of fire retardant fluid sufficient to produce the required amount of thrust in the inner, downwardly-directed portion of the spray pattern at pressures lower than those produced by either straight slots or slots that taper to become slightly wider in the radially outward direction.

According to the invention, an early suppression fast response pendent-type fire protection sprinkler suitable for use in accordance with one or more of NFPA 13, NFPA 231 and NFPA 231C to protect single row rack storage, double row rack storage and multiple row rack storage has a K-factor of about 25 and a flowing pressure of about 15 pounds per square inch.

Preferred embodiments of the invention may have one or more of the following additional features. The sprinkler further comprises a sprinkler body defining an orifice and an outlet for delivering a flow of fluid from a source, and a deflector mounted with a first surface opposed to flow of fluid from the outlet, the deflector defining at least two reentrant slots disposed in opposition about a deflector axis, the reentrant slots extending from the first surface through the deflector, and the reentrant slots extending from slot openings at an outer peripheral edge of the deflector inwardly from the peripheral edge toward the deflector axis. Preferably, the reentrant slots extend inwardly along reentrant slot centerlines, and each of the reentrant slots has a first width transverse to its reentrant slot centerline in a region of the peripheral edge and a second slot width transverse to its reentrant slot centerline in a region spaced inwardly, toward the deflector axis, relative to the region of the peripheral edge, the second width being greater than the first width. More preferably, the sprinkler further comprises an apex element, the deflector is mounted to the apex element, and an innermost portion of each of the reentrant slots extends inwardly toward the deflector axis to be no further outward from the deflector axis than an outermost surface of the apex element, and, preferably, the innermost portions of the reentrant slots extend inwardly toward the deflector axis to underlie the apex element, relative to fluid flow direction from the outlet. The reentrant slot centerlines extend radially outward from the deflector axis. The sprinkler is suited for installation up to 18 inches below a ceiling. The deflector has a thickness measured from the first surface in the direction of fluid flow equal to or greater than about 0.06 inch. The reentrant slots comprise a plurality of reentrant slots comprising at least a first type of reentrant slot and a second type of reentrant slot, reentrant slots of the first type extending from the first surface through the deflector with the slot openings at an outer peripheral edge of the deflector body, each of the reentrant slots of the first type extending inwardly from the peripheral edge, along the reentrant slot centerlines, generally toward the deflector axis, to a first type length, reentrant slots of the second type extending through the deflector from the first surface, with the slot openings at the peripheral edge of the deflector body, each of the reentrant slots of the second type extending inwardly from the peripheral edge, along the reentrant slot centerlines, generally toward the deflector axis, to a second type length, and the innermost portions of the reentrant slots of the first type extending inwardly toward the deflector axis to be no further outward from the deflector axis than the outermost surface of the apex element. Preferably, each of the reentrant slots of the first type has a first width transverse to its slot centerline in a region of the peripheral edge and a second width transverse to its slot centerline in a region spaced inwardly, toward the deflector axis, relative to the region of the peripheral edge, the second width of the first type slots being greater than the first width of the first type slots, and each of the reentrant slots of the second type has a first width transverse to the slot centerline in a region of the peripheral edge and a second width transverse to the slot centerline in a region spaced inwardly, toward the deflector axis, relative to the region of the peripheral edge, the second width of the second type slots being greater than the first width of the second type slots. The first type length is equal to or greater than the second type length. The reentrant slot centerlines of the reentrant slots of the first type extend substantially radially outward from the deflector axis. The reentrant slot centerlines of the reentrant slots of the second type extend substantially radially outward from the deflector axis. The reentrant slots of the first type comprise at least two pairs of generally opposing reentrant slots. The reentrant slots of the second type comprise at least two pairs of generally opposing reentrant slots. The first type length of the reentrant slots of the first type is substantially the same. The second type length of the reentrant slots of the second type is substantially the same. The reentrant slots of the first type define reentrant portions having an elongated shape. The reentrant slots of the second type define reentrant portions having a pear-shape. A reentrant slot of the second type is located between reentrant slots of the first type.

In another aspect of the invention, the deflector body defines reentrant slots including first and second types of reentrant slots, with each type including two or more reentrant slots. At least two, generally opposing reentrant slots of the first type of reentrant slots extend through the deflector body, from the first, inside surface to the second, outside surface, each with the slot opening at an outer peripheral edge of the deflector body and extending inwardly from the peripheral edge, along its reentrant slot centerline, generally toward the deflector axis, to a first type slot length. The reentrant slots of the first type have a first width measured transverse to the slot centerline in a region of the peripheral edge and a second width measured transverse to the slot centerline in a region spaced inwardly, toward the deflector axis, relative to the region of the peripheral edge, the second width being greater than the first width. At least two generally opposing reentrant slots of the second type of reentrant slots also extend through the deflector body, from the first, inside surface to the second, outside surface, with a slot opening at an outer peripheral edge of the deflector body, and extend inwardly from the peripheral edge, along its reentrant slot centerline, generally toward the deflector axis, to a second type slot length. The reentrant slots of the second type have a first width measured transverse to the slot centerline in a region of the peripheral edge and a second width measured transverse to the slot centerline in a region spaced inwardly, toward the deflector axis, relative to the region of the peripheral edge, the second width being greater than the first width. Each of the reentrant slots of the first type is disposed between reentrant slots of the second type, with the first type slot lengths being different from the second type slot lengths.

With this arrangement, the use of alternating pairs of generally opposing reentrant slots of the second type provides an intermediate componentized spray pattern. The intermediate componentized spray pattern is particularly effective in ESFR sprinkler applications where updrafts in regions between the outer shell regions and regions along the central axis of the sprinkler orifice are created. Such updrafts are often created in higher elevation, higher challenge settings (e.g., warehouses) where the increased elevation allows a fire to grow to a large size before operating a sprinkler head positioned off center from the ignition point of the fire.

These and other features and advantages of the invention will be apparent from the following more detailed description, and from the claims.

DESCRIPTION OF THE PREFERRED EMBODIMENTS

Figure 1:
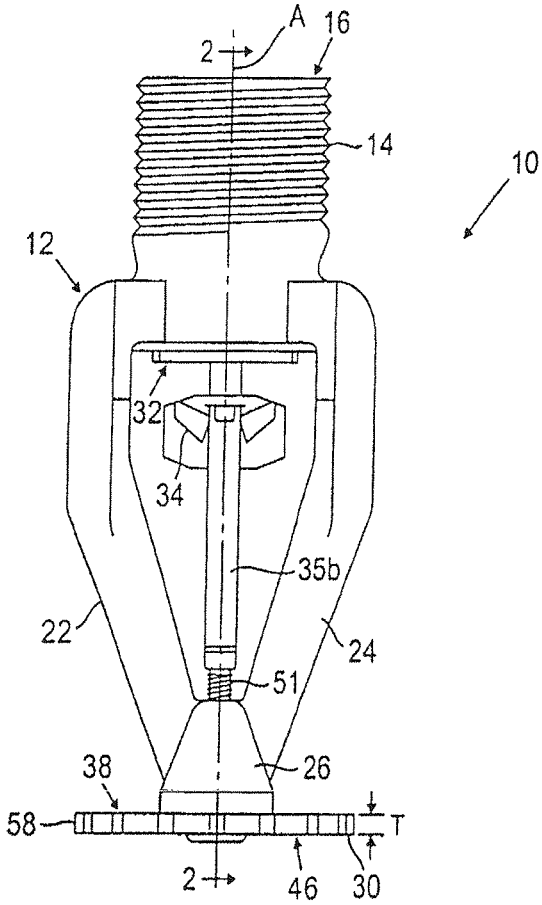
FIG. 1 is a side elevational view of a fire protection sprinkler of the invention.
Figure 2:
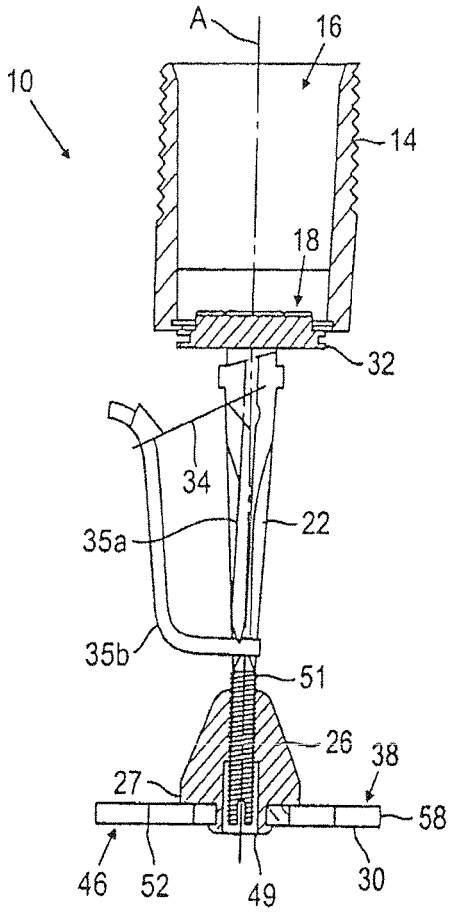
FIG. 2 is a side sectional view of the fire protection sprinkler taken at line 2-2 of FIG. 1.

Referring to FIGS. 1 and 2, a fire protection sprinkler 10 of the deflector impingement pendent-type has a body 12 with a base 14 defining an inlet 16 for connection to a source of fluid under pressure (not shown), and an outlet 18 (FIG. 2) with an axis, A. In certain embodiments, a strainer (not shown) may be located at inlet 16 to prevent debris larger than a preselected combination of dimensions from entering and clogging fluid flow through outlet 18. A pair of U-shaped frame arms 22, 24 extend from opposite sides of the base 14 to join at an apex element 26 at a position downstream of, and generally coaxial with, the outlet 18. Apex element 26 is generally conically-shaped, with the relatively wider diameter end adjacent to a water distribution deflector 30 affixed to, and disposed coaxial with, the apex element 26.

The outlet 18 of the fire protection sprinkler 10 is normally closed by a spring plate assembly 32. The assembly is held in place by a thermally responsive element 34 consisting of two thin sheet metal members secured together by a low temperature fusible solder alloy which separates and automatically releases the spring plate assembly when the thermally responsive element is heated to an elevated temperature within a specified operating temperature range for a pre-selected nominal temperature rating, e.g., 74° C. (165° F.). The retention force applied by the thermally responsive element is transmitted to the spring plate assembly 32 by the load applied through a strut 35*a* via lever 35*b*. In one particular embodiment, the thermally responsive element 34 is available, eg, from Grinnell Corporation, of Exeter, N.H., in temperature ratings of 74° C. (165° F.) and 101° C. (214° F.).

Upon release of spring plate 32, a vertically directed, relatively coherent, single stream of fluid passes through inlet 16, rushing downward from the outlet 18 towards 35 the deflector 30.

Heretofore, it has been known that the parameters establishing spray patterns for a pendent-type sprinkler operating by impacting a single, relatively coherent water jet against a substantially horizontal deflector, include:

- form and/or shape of the deflector support structure;
- form and/or shape of the deflector;
- outside dimensions of the deflector;
- shape and arrangement of openings and tines located around the periphery of the deflector; and
- shape, size, and arrangement of holes located within the central area of the deflector, when such holes are utilized in conjunction with slots and tines located around the periphery of the deflector.

Figure 3:
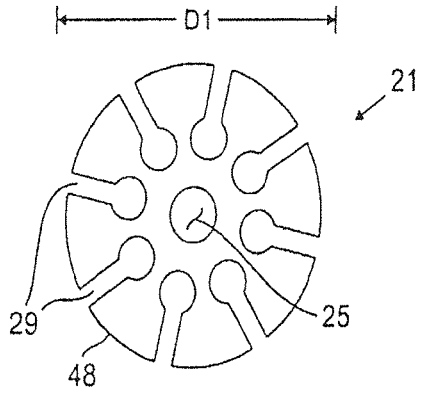
FIG. 3 is a top plan view of a deflector element for use in the fire protection sprinkler of FIG. 1.

Referring to FIG. 3, a deflector 21 of the invention for use in pendent-type fire protection sprinkler 10 has an outside diameter, $D_1$, e.g., a uniform value of about 1.75 inches. The deflector 30 has a thickness of about 0.09 inch, and it is fabricated from a phosphor bronze alloy UNS52100, per ASTM B103, with a Rockwell B Scale hardness of about 92. The diameter of deflector 21 is optimized to provide, from a predetermined height, a particular spray pattern over a desired area to be protected from fire. The outside diameter is limited by the volume of fire retardant fluid, and by the size of the orifice. Moreover, where cost is a consideration, increasing the size of the deflector diameter requires the thickness of deflector 21 to be increased in order to ensure that it has sufficient rigidity to withstand the force of the discharged stream of fluid.

The deflector 21 has an inside surface 38 (FIG. 1) downstream of, and facing towards, i.e. opposing, the deflector outlet 18, and an outside surface 46 (FIG. 1) on the opposite side of the deflector, i.e. facing away from the deflector outlet. The inside surface of the deflector 21 includes a substantially flat, central base area 48 (FIGS. 3 and 5A) having a central hole 25 for mounting to the apex element 26.

A grouping of equally spaced reentrant slots 29, e.g. at least about four, and preferably about eight, as shown in FIG. 3, are symmetrically located about the periphery of the deflector through the body of the deflector 21, i.e. from the inside surface to the opposite outside surface of the deflector. The radially innermost portions of the reentrant slots are substantially in line axially with the outer peripheral surface 27 (FIG. 2) of the apex element 26 of the sprinkler frame, or extend beneath, i.e. underlie, in the direction of fire retardant fluid flow, the outermost surface apex element 26, as shown in FIG. 2.

With this arrangement, it has been found that a relatively greater quantity of fire retardant fluid can be diverted to produce a relatively greater amount of thrust in the inner, downwardly-directed portion (i.e., the central core) of the spray pattern at lower pressures, as compared to the amount of central core thrust generated by prior art deflectors, e.g. those having straight slots or slots which are slightly tapered in a direction radially outward from the deflector axis.

Figure 4:
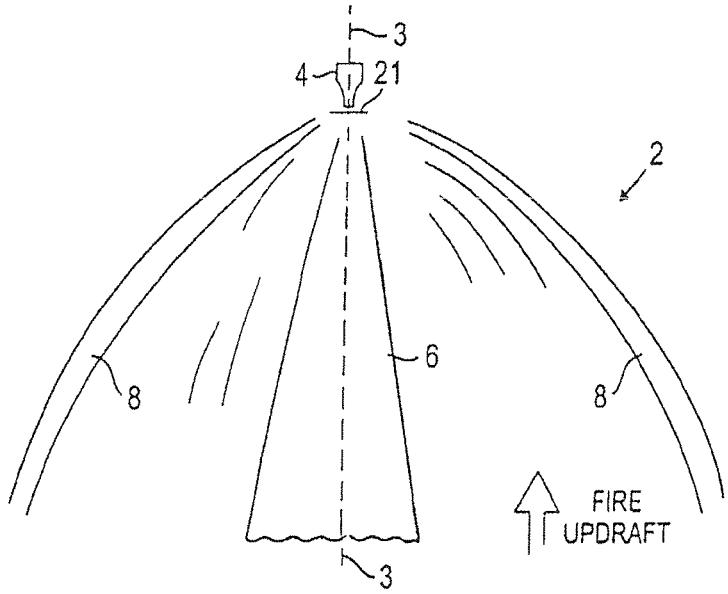
FIG. 4 illustrates a spray pattern for a fire protection sprinkler having a deflector with reentrant slots.

Referring to FIG. 4, a spray pattern for a commercial ESFR fire protection sprinkler with the deflector 21 having reentrant slots 27 is illustrated. The reentrant slots 27 result in a spray pattern 2 in which the spray direction is altered towards a center main axis 3 of a sprinkler 4. In particular, the reentrant slots 27 of the deflector result in formation of a central core 6 of spray pattern 2, with tines of the deflector resulting in formation of an outer shell 8 of spray pattern 2. In particular, the central core portion 6 of the spray pattern 2 has fluid droplets with greater momentum (i.e. mass times velocity), at relatively lower inlet pressures, than provided by prior art sprinklers of similar purpose.

As will be described in greater detail below, in other ESFR sprinkler applications, it may be desired to alter the spray pattern to provide additional concentrations of fluid spray, e.g., other than the central core and outer umbrella-shaped portions.

Figure 5:
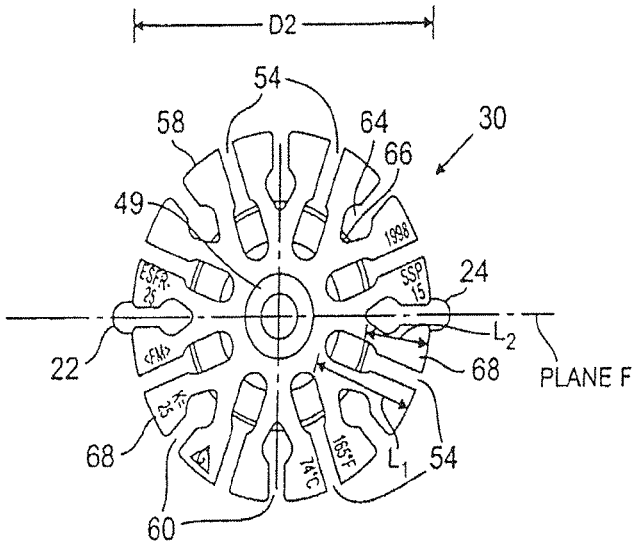
FIG. 5 is a top plan view of an alternate embodiment of a deflector element for use in the fire protection sprinkler of FIG. 1.

For example, referring to FIG. 5, the deflector 30 of the deflector impingement-type, automatic fire protection sprinkler 10 of the invention has an outside diameter, $D_2$, e.g., a uniform value of about 1.75 inches. The deflector 30, having a thickness, T (FIG. 1), e.g. about 0.09 inch, is fabricated from a phosphor bronze alloy UNS52100, per ASTM B103, with a Rockwell Scale B hardness of about 92.

Referring again to FIG. 5, as well as to FIG. 2, deflector 30 has an inside surface 38 downstream of, and facing towards, i.e. opposing, the nozzle outlet 18, and an outside surface 46 on the opposite side of the deflector, i.e. facing away from the nozzle outlet. The inside surface 38 of the deflector 30 includes a substantially flat, central base area 48 having a central hole 49 for mounting to the apex element 26.

Figure 5A:
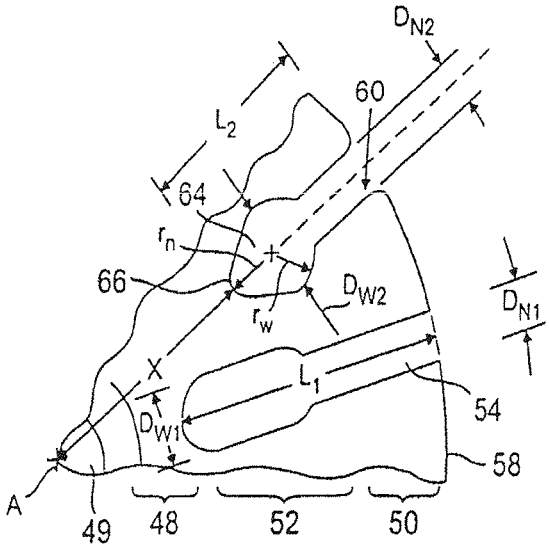
FIG. 5A is a similar enlarged view of the region A-A of FIG. 5.

Referring particularly to FIGS. 5 and 5A, a first grouping of a first type of equally spaced reentrant slots 54, e.g., preferably at least one pair of generally opposing reentrant slots, more preferably at least two pairs of generally opposing slots, and most preferably about four pairs of generally opposing slots, are symmetrically located around the periphery of deflector 30 and extend from the inside surface 38 to the opposite outside surface 46, and thus through the body of the deflector 30. Each reentrant slot 54 extends a radial length $L_1$, e.g., in the range of about 0.52 inch to about 0.62 inch, and preferably about 0.57 inch, from an outer peripheral edge 58 of the deflector inward towards base area 48. The reentrant slots 54 are elongated in shape and angularly spaced from each other in a range between about 40° to 50° and preferably, as shown here, the angular spacing is about 45°. Further, the elongated reentrant slots 54 have a first width, $D_{n1}$, measured transversely to the slot centerline in a region of the peripheral edge 58, in the range of about 0.08 inch to 0.010 inch, and preferably about 0.09 inch, and a second width, $D_{w1}$, measured transversely to the slot centerline in a region spaced inwardly from the peripheral edge, in the range of about 0.13 inch to 0.17 inch, and preferably about 0.15 inch.

A second grouping of a second type of equally spaced reentrant slots 60 (e.g., preferably at least one pair of generally opposing slots, more preferably at two pairs of generally opposing slots, and most preferably at least four pairs of generally opposing slots, as shown in FIG. 5) are symmetrically positioned between adjacent reentrant slots 54. Referring also to FIG. 5A, like reentrant slots 54, reentrant slots 60 extend from inside surface 38 to opposite outside surface 46, through the body of deflector 30. Moreover, reentrant slots 60 extend from outer peripheral edge 58 of the deflector towards base area 48 by a radial length $L_2$, e.g., in the range of about 0.32 inch to about 0.42 inch, and preferably about 0.37 inch. Reentrant slots 60 are preferably pear-shaped and extend into an intermediate region 52, with a relatively wider end 64 of each reentrant slot 60 having a radius, $r_w$, e.g., in the range of about 0.04 inch to about 0.08 inch, and preferably about 0.06 inch. The innermost, narrower end 66 of each slot 60, located relatively closer to the deflector axis, A, than the wider portion 64, has a radius, $r_n$, e.g., in the range of about 0.04 inch to about 0.06 inch, and preferably about 0.05 inch. Reentrant slots 60 are angularly spaced from each other in the range of between about 40° to 50° and preferably, as shown here, the angular spacing is about 45°. Further, the generally triangular-shaped or, more specifically, pear-shaped reentrant slots 60 have a first width, $D_{n2}$, measured transversely to the slot centerline in a region of the peripheral edge 58, in the range of about 0.08 inch to 0.10 inch, and preferably about 0.09 inch, and a second width, $D_{w2}$ measured transversely to the slot centerline in a region spaced inwardly from the peripheral edge, in the range of 0.16 inch to 0.20 inch, and preferably about 0.18 inch.

Tines 68 are defined by that portion of the deflector body extending from central base area 48 and including those regions between reentrant slots 54 and reentrant slots 60. The shape of reentrant slots 60 is somewhat dependent on the shape of reentrant slots 54. In particular, the pear-shape of reentrant slots 60 ensures that the width of tines 68 between reentrant slots 54 and 60 is sufficient to provide the desired structural rigidity to the deflector body, as well as to facilitate manufacture of the body, e.g., when stamped or machined.

Figure 6:
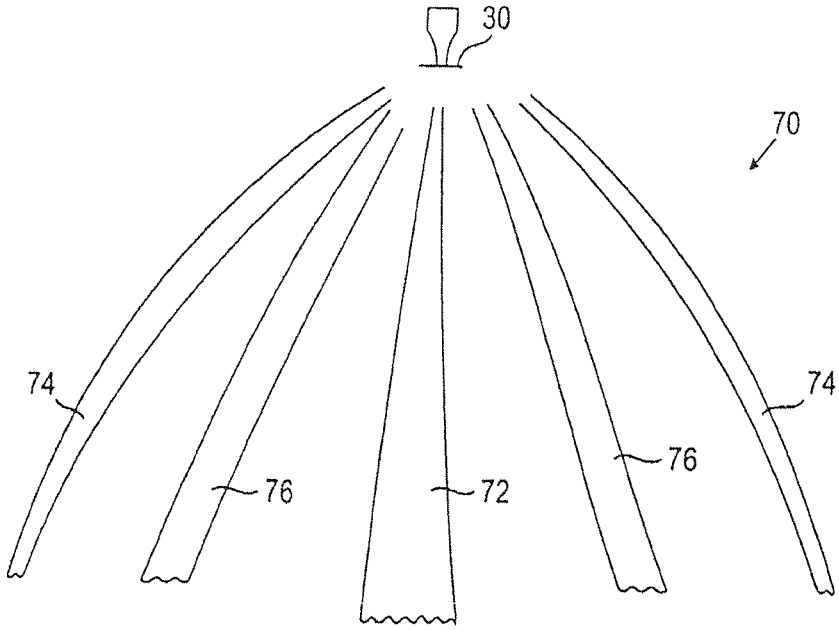
FIG. 6 illustrates a spray pattern provided by the fire protection sprinkler using the deflector element of FIG. 5.

Referring to FIG. 6, in operation, a stream of fire retardant fluid, e.g. water, from the outlet 18 impacting upon the opposed, inside surface 38 of the deflector 30 is diverted generally radially downward and outward by the deflector, being broken into a spray pattern consisting of a superimposed combination of an outer, umbrella-shaped pattern component, an intermediate, componentized spray pattern component, and an inner, generally conical-shaped pattern component, the configuration of the spray pattern being primarily a function of deflector design.

Referring to FIG. 6, and in contrast to FIG. 4, automatic fire protection sprinkler 10 having deflector 30, in operation, provides a spray pattern 70 well-suited for ESFR sprinkler applications. In particular, reentrant slots 54 cause the spray to form a central core 72, tines 68 cause the spray to form an outer shell 74, and reentrant slots 60 cause the spray to form secondary thrust regions 76 in an intermediate zone, between central core 72 and outer shell 74, of the spray pattern 70.

In addition, referring again to FIG. 5, in a preferred embodiment, deflector 30 is positioned with a pair of reentrant slots 60 disposed in plane, F, of the sprinkler frame arms 22, 24.

A commercial embodiment of the automatic fire protection sprinkler 10 of the invention is represented by a 25.2 K-Factor, Model ESFR-25™ pendent sprinkler assembly, available from Grinnell Corporation, 3 Tyco Park, Exeter, N.H. 03833.

The 25.2 K-Factor, Model ESFR-25™ pendent sprinkler is listed and approved by Factory Mutual Research Corporation (FM) as an "Early Suppression Fast Response Pendent Sprinkler" designed for use with wet pipe, automatic sprinkler systems for the fire protection of high-piled storage. The Model ESFR-25™ pendent sprinkler is a suppression mode sprinkler, and its use is especially advantageous as a means for eliminating use of in-rack sprinklers. Acceptable storage arrangements which can be protected by the Model ESFR-25™ pendent sprinkler include open-frame single-row rack, double-row rack, multiple-row rack, and portable rack storage, as well as palletized and solid-piled storage, of most encapsulated or non-encapsulated, common materials including cartoned unexpanded plastics. In addition, the protection of some storage arrangements of roll paper and rubber tires can be considered as well.

The FM listing and approval of the Model ESFR-25™ pendent sprinkler permits it to be used to protect encapsulated and non-encapsulated, Class I, II, III, and IV, as well as cartoned unexpanded plastics, at design pressures based on maximum storage and ceiling heights, as shown in Table I, below.

TABLE I

| Maximum Storage Height, Ft. (m) | Maximum Ceiling Height, Ft. (m) | Minimum Flowing Pressure, psi (bar) |
|---|---|---|
| 40 (12.2) | 45 (13.7) | 50 (3.4) |
| 35 (10.7) | 40 (12.2) | 40 (2.7) |
| 30 (9.1) | 35 (10.7) | 30 (2.1) |
| 25 (7.6) | 30 (9.1) | 20 (1.4) |

The FM listing and approval of the Model ESFR-25™ pendent sprinkler permits it to be used to protect heavy and medium weight paper storage, as indicated in Table II, below. These guidelines are applicable to banded or unbanded rolls in open, standard, or closed array. The design includes a hose stream allowance of 250 gpm (950 lpm), and the water supply duration is to be a minimum of 1 hour.

TABLE II

| Maximum Storage Height, Ft. (m) | Maximum Ceiling Height, Ft. (m) | Minimum Flowing Pressure, psi (bar) |
|---|---|---|
| Heavy Weight | | |
| 25 (7.6) | 30 (9.1) | 20 (1.4) |
| 30 (9.1) | 40 (12.2) | 40 (2.7) |
| 30 (9.1) | 45 (13.7) | 50 (3.4) |

TABLE II-continued

| Maximum Storage Height, Ft. (m) | Maximum Ceiling Height, Ft. (m) | Minimum Flowing Pressure, psi (bar) |
|---|---|---|
| | Plastic Coated Heavy Weight | |
| 20 (6.1) | 30 (9.1) | 20 (1.4) |
| 20 (6.1) | 40 (12.2) | 40 (2.7) |
| | Medium Weight | |
| 20 (6.1) | 30 (9.1) | 20 (1.4) |
| 20 (6.1 | 40 (12.2) | 40 (2.7) |

The FM listing and approval of the Model ESFR-25™ pendent sprinkler also permits its use for protection of on-side and on-tread (not interlaced) storage of rubber tires in open frame racks to a maximum height of 25 feet (7.6 m) under ceilings no higher than 30 feet (9.1 m). The sprinkler system must be designed to supply twelve sprinklers at 20 psi (1.4 bar), flowing four sprinklers per branch on three branch lines. Sprinklers must be rated 165°/74° C. All other guidelines of FM Loss Prevention Data Sheet 2-2 must be followed, except that the hose stream demand must be 500 gpm (1900 lpm) and the water supply duration must be a minimum of 2 hours.

The 25.2 K-Factor, Model ESFR-25™ pendent sprinkler is also listed by Underwriters Laboratories Inc. (UL) and by UL for use in Canada (C-UL) as a "Specific Application Early Suppression Fast Suppression Sprinkler" for use in accordance with NFPA 13, NFPA 231, and NFPA 231C (the complete disclosures of each of which are incorporated herein by reference) to protect single-row rack, double-row rack, and multiple row rack storage (no open top containers or solid shelves) and palletized and solid pile storage (no open containers or solid shelves), of most encapsulated or non-encapsulated, common (Class I, II, III and IV commodities) materials, including cartoned unexpanded plastics, when installed with the maximum ceiling and storage heights and minimum design pressures shown in Table III, below.

TABLE III

| Maximum Storage Height, Ft. (m) | Maximum Ceiling Height, Ft. (m) | Minimum Flowing Pressure, psi (bar) |
|---|---|---|
| 40 (12.2) | 45 (13.7) | 40 (2.7) |
| 35 (10.7) | 40 (12.2) | 25 (1.7) |
| 30 (9.1) | 35 (10.7) | 20 (1.4) |
| 25 (7.6) | 30 (9.1) | 15 (1.0) |

In particular, the Model ESFR-25™ pendent sprinkler is designed to operate at substantially lower end head pressures, as compared to ESFR sprinklers having a nominal K-Factor of 14. This feature offers flexibility when sizing the system piping, as well as possibly reducing or eliminating the need for a system fire pump. Also, the Model ESFR-25™ pendent sprinkler permits use of a maximum deflector-to-ceiling distance of 18 inches (460 mm), as compared to a maximum of 14 inches (360 mm) for ESFR sprinklers with a K-factor of 14.

Using a Model ESFR-25™ pendent sprinkler assembly, data was collected for comparison of fluid densities released over an area representing the top of stacked commodities, e.g., boxes, in a warehouse setting.

Referring to FIGS. 7-10, the test area is shown as a pictorial array defining 0.5 meter square regions 90 representing the top surfaces of the stacked commodities, surrounded by flue regions 92, i.e., spaces between the stacked commodities, e.g., about six inches wide. A discharging sprinkler 94 is centrally located at point 96. The vertical distance between the sprinkler deflector and the top of the fluid collector area is 8 feet, 6 inches.

In each region there is shown a fluid density value representing the actual measured amount of fluid volume, in gallons per minute per square foot, falling within that region. The fluid density values are employed to determine weighted average values of ADD (Actual Delivered Density) over different regions of the array. Of particular interest is the region identified as "central core ADD" which represents a weighted average of the central sixteen square regions 90 and the four flue regions surrounding point 96.

Figure 7:
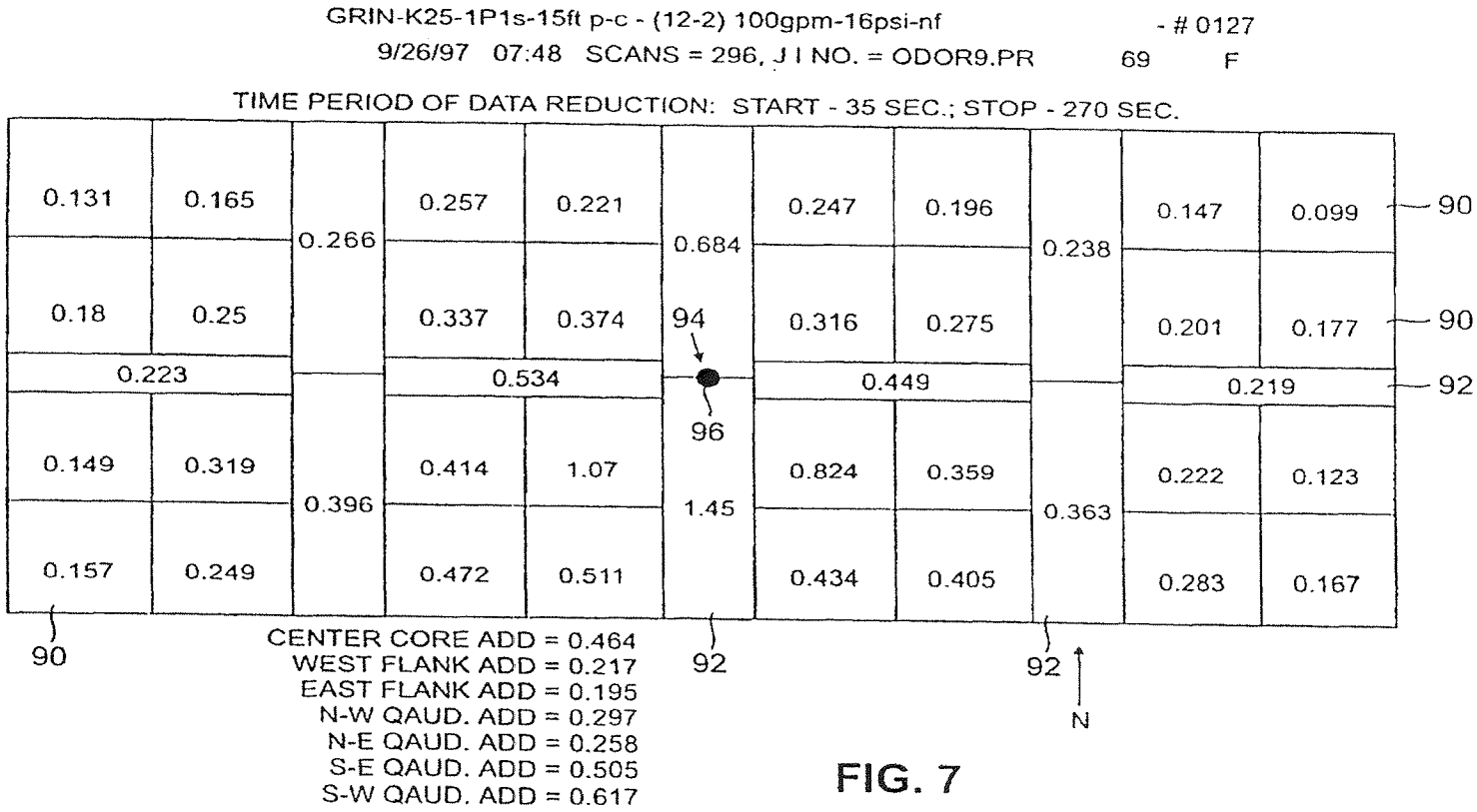
FIG. 7 PRIOR ART
FIG. 7 is a chart of ADD test data in a no-fire, water spray only condition for a typical straight-slotted deflector.
Figure 8:
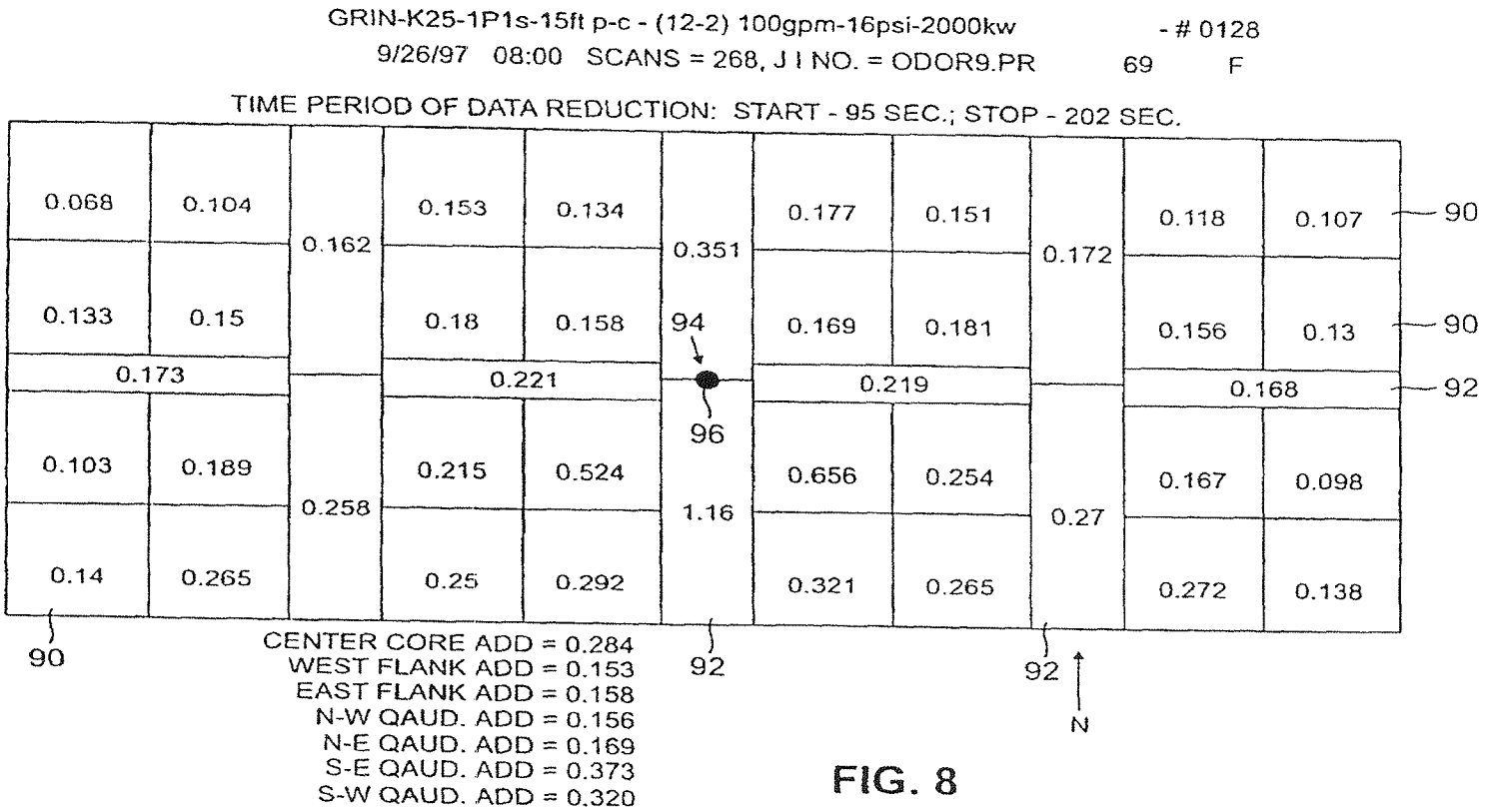
FIG. 8 PRIOR ART
FIG. 8 is a chart of ADD test data with a simulated 2,000 kw fire located directly beneath the primary axis of the sprinkler for the same typical straight-slotted deflector.

Referring to FIG. 7, fluid density data collected using a conventional (prior art) deflector affixed to a 25.2 K-factor sprinkler with straight slots in a no-fire, water spray only condition is shown. FIG. 8 shows the fluid density data collected using the same straight-slotted deflector design in a 2,000 kw fire located directly below the primary vertical axis of the discharging 25.2 K-factor sprinkler 94. The data shows that a substantial reduction in the collected densities of fire protection fluid occurs when the sprinkler is tested with a 2,000 kw fire.

Figure 9:
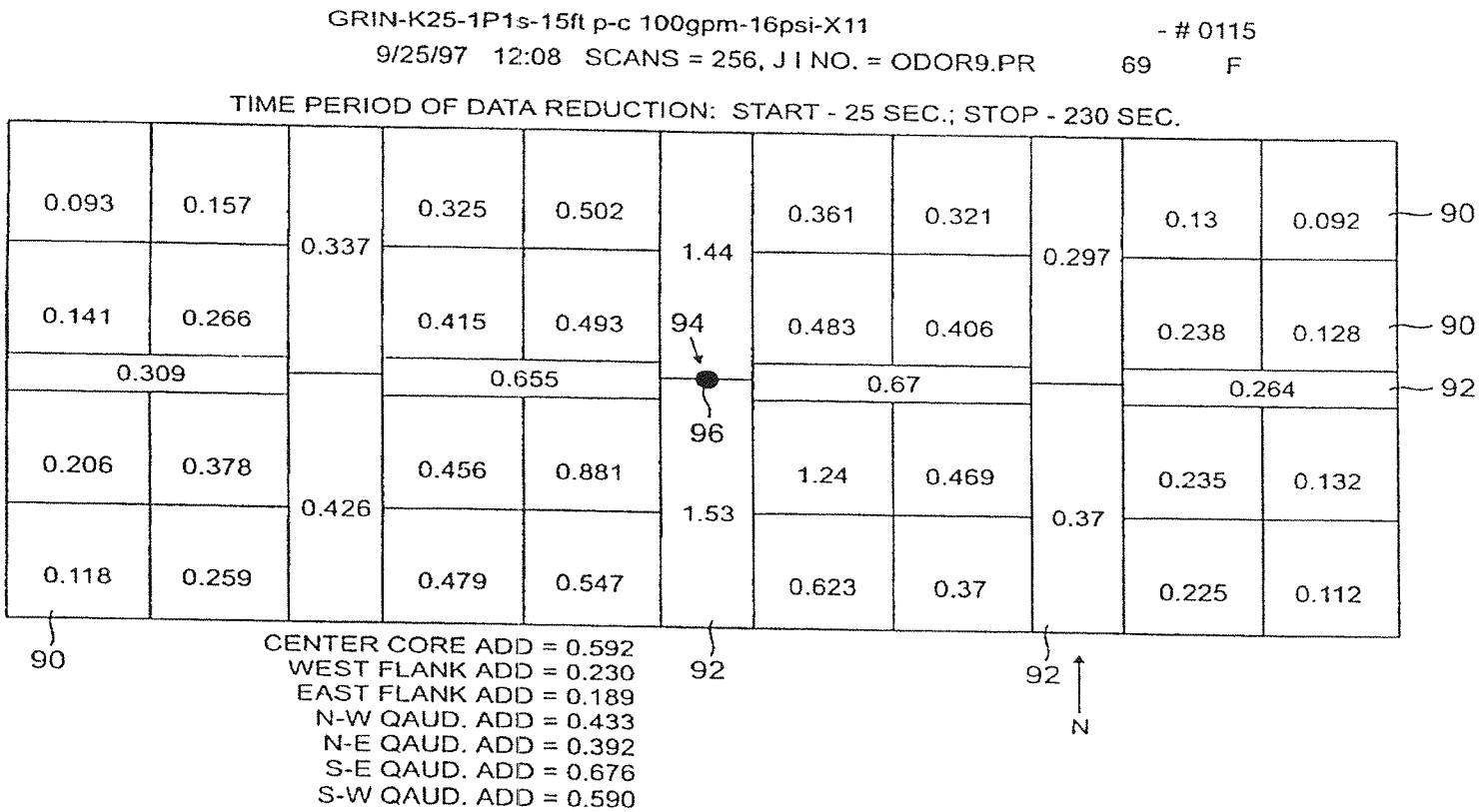
FIG. 9 is a chart of ADD test data in a no-fire, water spray only condition using a sprinkler having a deflector in accordance with the invention.
Figure 10:
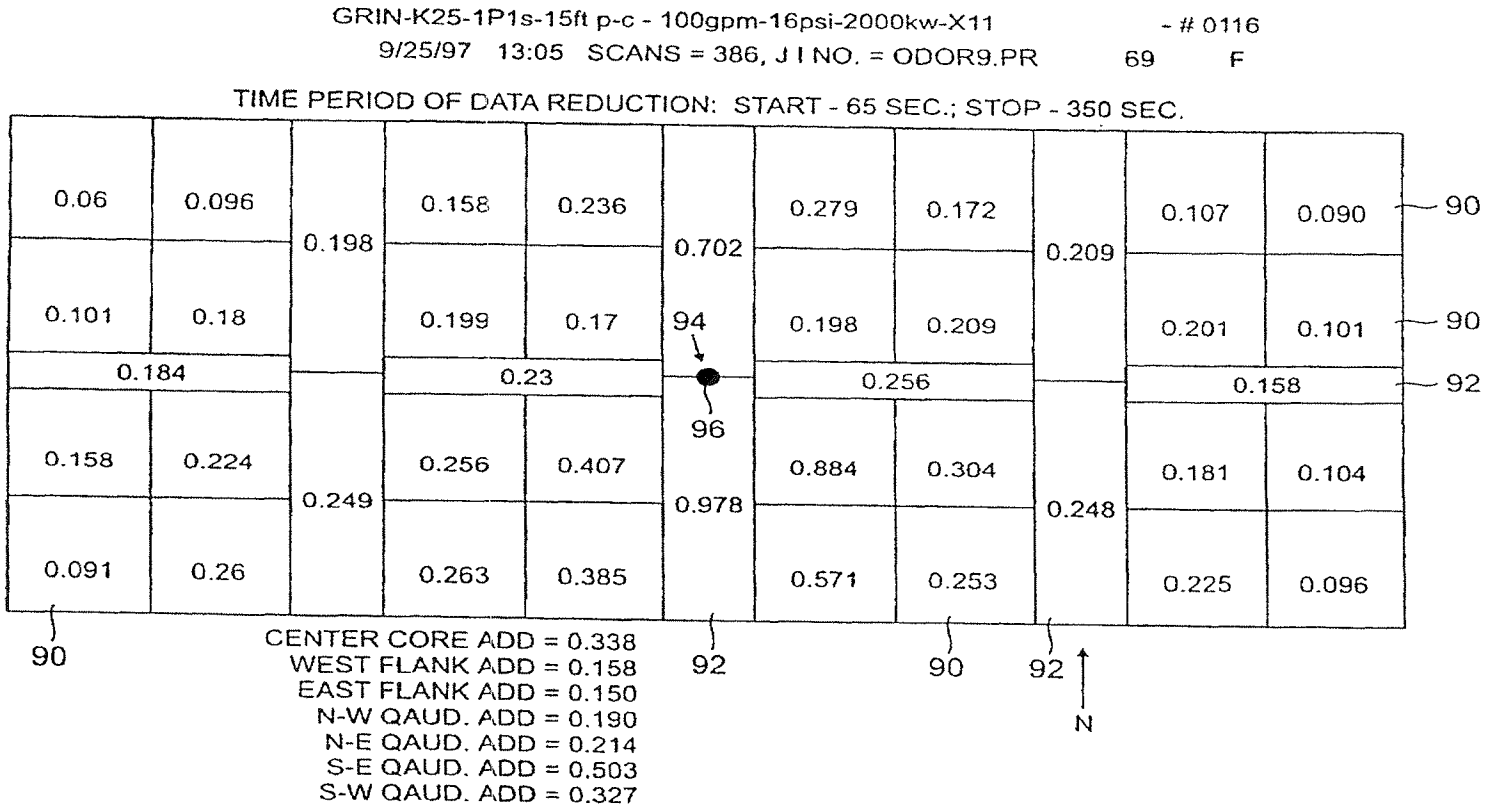
FIG. 10 is a chart of ADD test data with a simulated 2,000 kw fire located directly beneath the primary axis of the sprinkler using a sprinkler having a deflector in accordance with the invention.

Referring to FIGS. 9 and 10, fluid density data collected using a 25.2 K-factor fire protection sprinkler with a deflector 30 in accordance with the invention is shown. In particular, FIG. 9 represents collected data in the no-fire, water spray only condition and FIG. 10 represents collected data in the 2,000 kw fire condition. The aforementioned tests were conducted under identical pressure and flow conditions. Of particular interest is the substantial increase in center core ADD provided by the sprinkler having the deflector 30 of the invention, as compared to the conventional straight-slotted deflector. Moreover, this increase in center core ADD performance is achieved with substantially no sacrifice in performance at peripheral regions.

Another type of water distribution test, the so-called "10 Pan Distribution Test," such as that described in the Apr. 8, 1997, edition of UL 199, Standard for Automatic Sprinklers for Fire-Protection Service, the complete disclosure of which is incorporated herein by reference, provides another means for describing the benefit of use of reentrant slots and, in particular, the reentrant slots 60 of the deflector 30 of this invention. Referring to FIG. 30.1 of the Apr. 8, 1997 edition of UL 199, with a 25.2 K-factor conventional (prior art) sprinkler having straight slots and in a no-fire, water spray only condition, an average water density of about 0.82 gallon per minute per square foot was measured in the 1 foot long by 1 foot wide pan centered at a 3 foot radius from the primary vertical axis of the sprinkler when it was flowing 100 gallons per minute. By comparison, with a 25.2 K-factor fire protection sprinkler having a deflector 30 in accordance with the invention, an average water density of about 1.3 gallons per minute per square foot was measured in the 1 foot long by 1 foot wide pan centered at a 3 foot radius from the primary vertical axis of the sprinkler when it was flowing 100 gallons per minute.

Other embodiments are within the following claims. For example, the outlet 18 may have a non-circular cross-section. The sprinkler 10 may have a K-factor in the range of about 8.0 to 50.0, preferably in the range from about 14.0 to 30.0, more preferably in the range of about 22.0 to about 28.0, and most preferably the K-factor is about 25.0.

Deflectors of the invention having one group of reentrant slots, e.g. slots 27 of deflector 21 (FIG. 3), may have slots of different lengths. In deflectors of the invention having two groups of reentrant slots, e.g. slots 54, 60 of deflector 30 (FIG. 5), slots within each group of slots may also have different lengths, and/or a third set of reentrant slots or holes may be employed to provide a different spray pattern. In deflectors of the invention having three groups of reentrant slots, the slots may be arranged in a pattern such as abcbabcba. The numbers of reentrant slots in each group also may vary. Moreover, the slots need not extend radially to the periphery of the deflector but may be provided in non-radial arrangements.

The peripheral edge 58 of the outer area 50 of the deflector 30 may define ridges in the radial outward direction from the deflector axis. Although deflector 30 is described above as a plate-like member, the deflector need not be flat but may, e.g., be wavy or frusto-conical in shape. The deflector 30 may also have variations in the shape and dimensions of the reentrant slots 60 through the intermediate region 52 of the deflector inner surface 38, e.g., referring also to FIG. 5A, in length, $L_2$, radius, $r_n$, and/or radius, $r_w$, and/or radial spacing, X, from the deflector axis, A. Frame arms 22, 24 can have a wide variety of shapes, mounting or support arrangements, e.g., the deflector 30 may be positioned inside, rather than outside, frame arms 22, 24, and the frame arms may be affixed to the deflector 30, rather than to the apex element 26.

The apex element 26 need not be generally conically-shaped, as shown in FIG. 2, but may be curved in the direction of the orifice axis, eg, to achieve specific water distribution objectives. Opposing vertical sides of the reentrant slots may not be identical.

All of the above are applied without departing from the spirit and scope of this invention.

What is claimed is:

1. An early suppression fast response pendent-type fire protection sprinkler comprising:

a sprinkler body defining an orifice and an outlet for delivering a flow of fluid from a source, and having a K-factor of about 25;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to address a fire in at least one of a single row rack storage, double row rack storage and multiple row rack storage having a maximum storage height of up to about 40 feet in a storage area having a maximum ceiling height of up to about 45 feet, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector inwardly to a radially innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot in the one grouping, each slot of another grouping of the at least two groupings of slots having a second width transverse to the slot centerline of the slot in the other grouping and different than the first width, one grouping of the at least two grouping of slots having at least four slots disposed to one side of the plane, and another grouping of slots having a pair of opposed radial slots disposed in the plane and three radial slots disposed to one side of the plane, at least one pair of slots of one grouping of the at least two groupings of slots having the innermost portion no further outward from the deflector axis than the peripheral surface of the apex, each slot of the other grouping of slots having the innermost portion further outward from the deflector axis than the peripheral surface of the apex.

2. An early suppression fast response pendent-type fire protection sprinkler comprising:

a sprinkler body defining an orifice and an outlet for delivering a flow of fluid from a source, and having a K-factor of about 25;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to address a fire in at least one of a single row rack storage, double row rack storage and multiple row rack storage having a maximum storage height of up to about 40 feet in a storage area having a maximum ceiling height of up to about 45 feet, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector inwardly to a radially innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot in the one grouping, each slot of another grouping of the at least two groupings of slots having a second width transverse to the slot centerline of the slot in the other grouping and different than the first width, one grouping of the at least two grouping of slots having at least four slots disposed to one side of the plane, and another grouping of slots having a pair of opposed radial slots disposed in the plane and three radial slots disposed to one side of the plane, at least one pair of slots of one grouping of the at least two groupings of slots having the innermost portion substantially aligned with the outer peripheral surface of the apex, each slot of the other grouping of slots having the innermost portion between the outer peripheral edge of the deflector and the outer peripheral surface of the apex.

3. The early suppression fast response pendent-type fire protection sprinkler of any one of claims 1 and 2, wherein each of the slots in the at least two groupings of slots are reentrant slots.

* * * * *